United States Patent [19]

Stanton

[11] 4,406,597

[45] Sep. 27, 1983

[54] METHOD FOR PUMPING A LIQUID FROM A WELL AND APPARATUS FOR USE THEREIN

[75] Inventor: George E. Stanton, Orient, Ohio

[73] Assignee: Nujack Oil Pump Corporation, Columbus, Ohio

[21] Appl. No.: 200,899

[22] Filed: Oct. 27, 1980

Related U.S. Application Data

[63] Continuation-in-part of Ser. No. 156,780, Jun. 5, 1980, Pat. No. 4,346,620.

[51] Int. Cl.[3] ..... F04B 47/04; F04B 47/14

[52] U.S. Cl. ..... 417/399; 91/219; 60/372; 60/416

[58] Field of Search ..... 417/398, 399; 91/219, 91/5; 60/371, 372, 413, 414, 416

[56] References Cited

U.S. PATENT DOCUMENTS

| | | | |
|---|---|---|---|
| 852,061 | 4/1907 | Hoffman | 417/53 |
| 1,607,239 | 11/1926 | Clapp | 417/390 |
| 2,279,057 | 4/1942 | Reed | 60/372 |
| 2,555,427 | 6/1951 | Trautman | 60/372 |
| 2,681,623 | 6/1922 | Kane . | |
| 2,683,424 | 7/1954 | Kane . | |
| 2,934,899 | 5/1960 | Koplin et al. | 60/369 |
| 3,153,387 | 10/1964 | Sadouet . | |
| 3,158,048 | 11/1964 | Bollar | 78/42 |
| 3,782,117 | 1/1974 | James | 60/372 |
| 3,797,366 | 3/1974 | Hanes et al. | 91/404 |
| 4,049,365 | 9/1977 | Sparks, Sr. | 417/554 |
| 4,099,447 | 7/1978 | Ogles | 60/372 |
| 4,147,477 | 4/1979 | Chardonneau et al. | 417/343 |
| 4,161,137 | 7/1979 | Gaddy | 92/13 |
| 4,187,680 | 2/1980 | Sanford | 60/369 |

*Primary Examiner*—Leonard E. Smith
*Attorney, Agent, or Firm*—Millard & Cox

[57] ABSTRACT

A pumping method, principally for oil, allows the sucker rod to fall under gravity for the first part of the downward stroke, then decelerates the sucker rod to a slow rate of descent, so creating a pause in the sucker rod's motion. Shock-absorbing means are provided to eliminate the impulsive loadings imposed upon the sucker rod at either extremity of its motion in conventional pumping methods. Hydraulically and mechanically-driven apparatus is disclosed for carrying out the method.

32 Claims, 19 Drawing Figures

FIG. 2
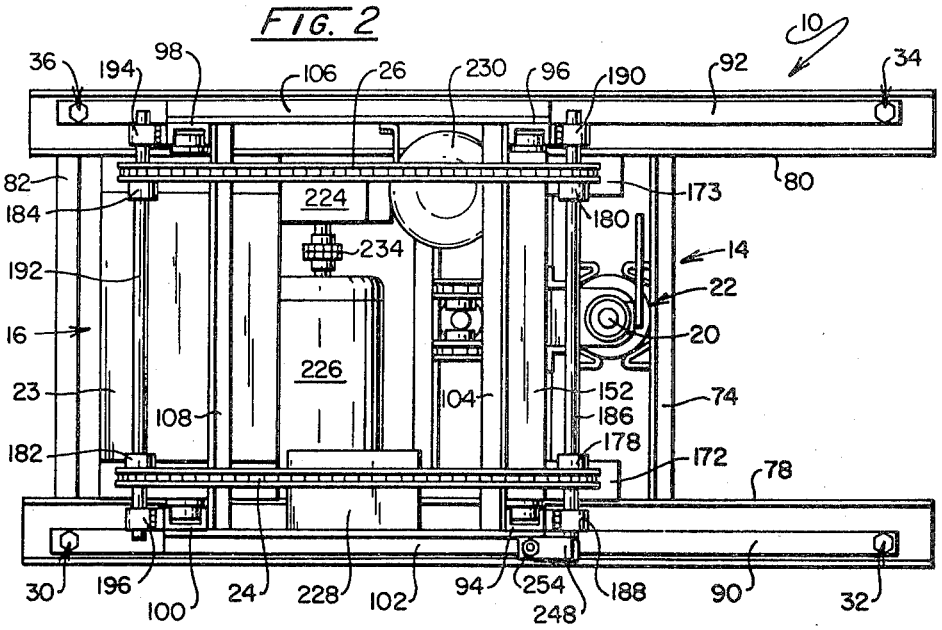
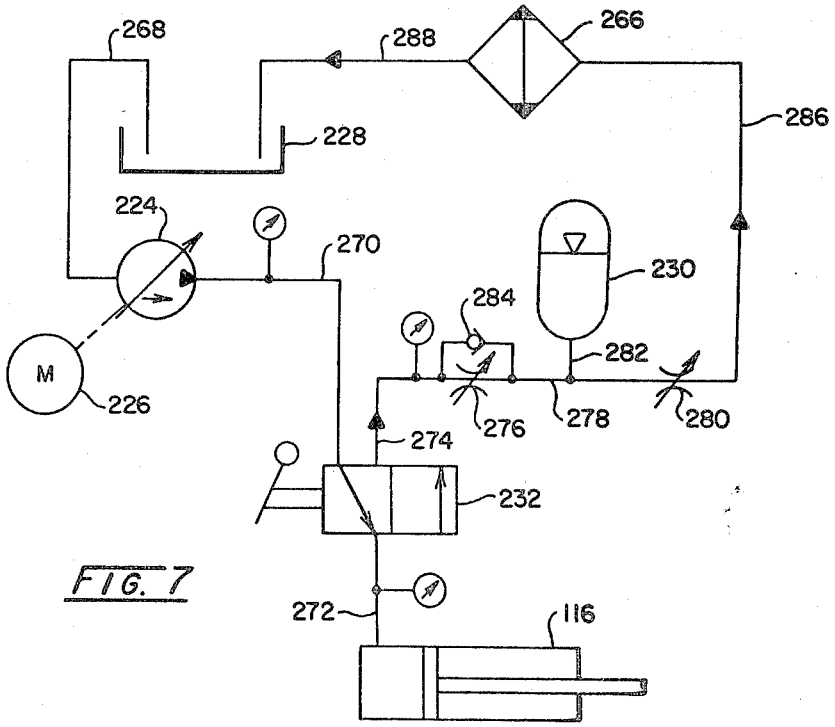
FIG. 7

500
502
508
506
510
514
512
504
170
530
532
534
516
518
522
520
524
528
20
526
76

FIG. 15
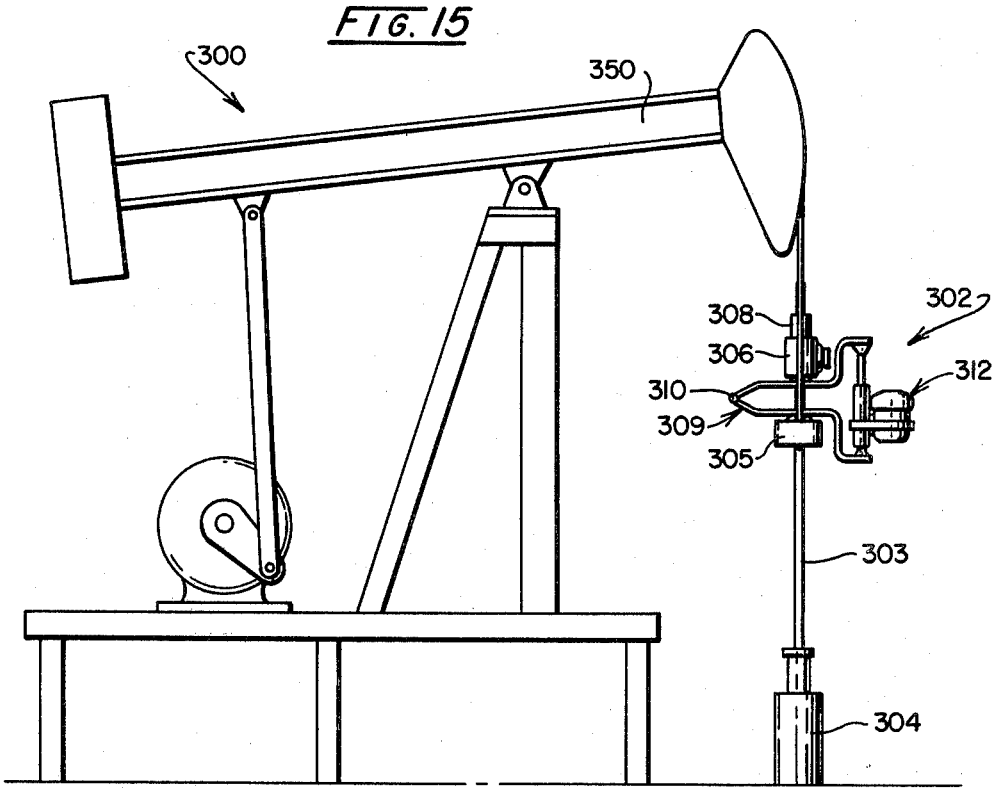
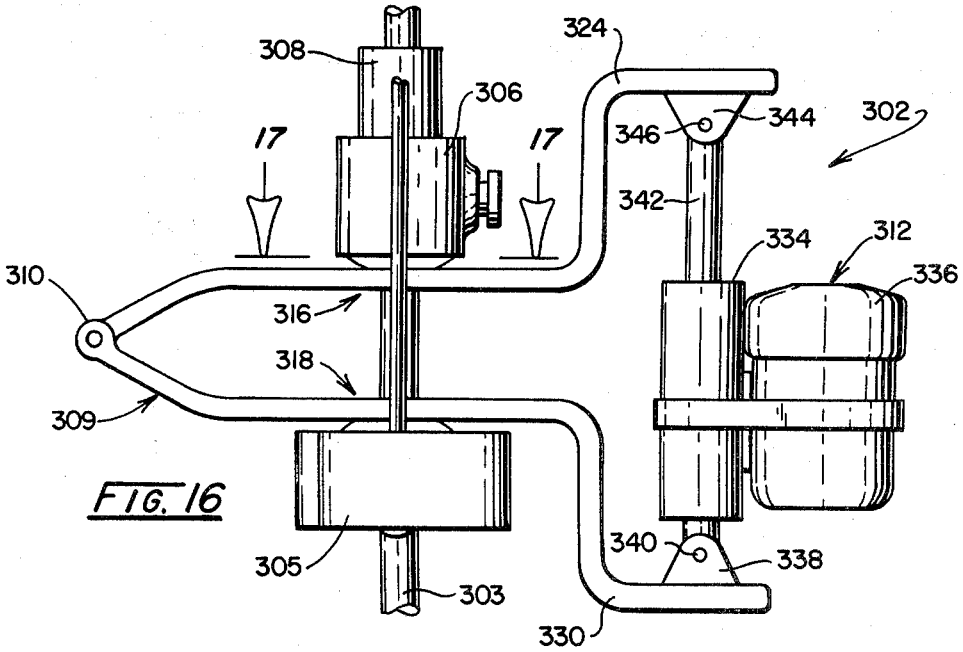
FIG. 16

FIG. 17
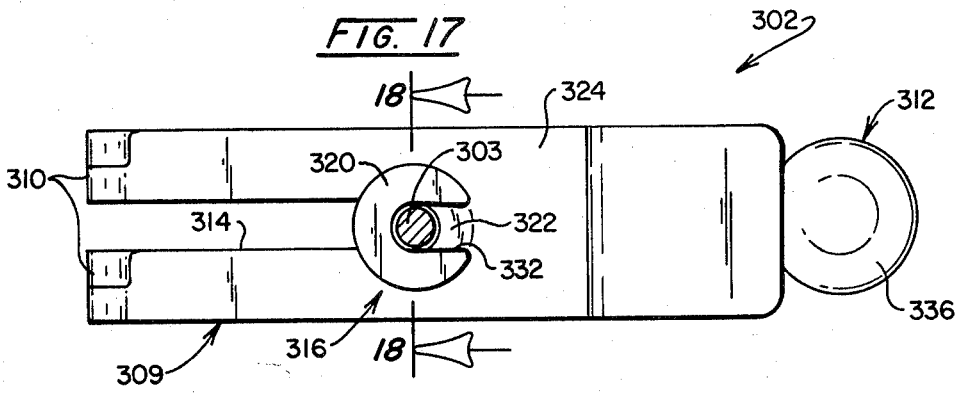
FIG. 18
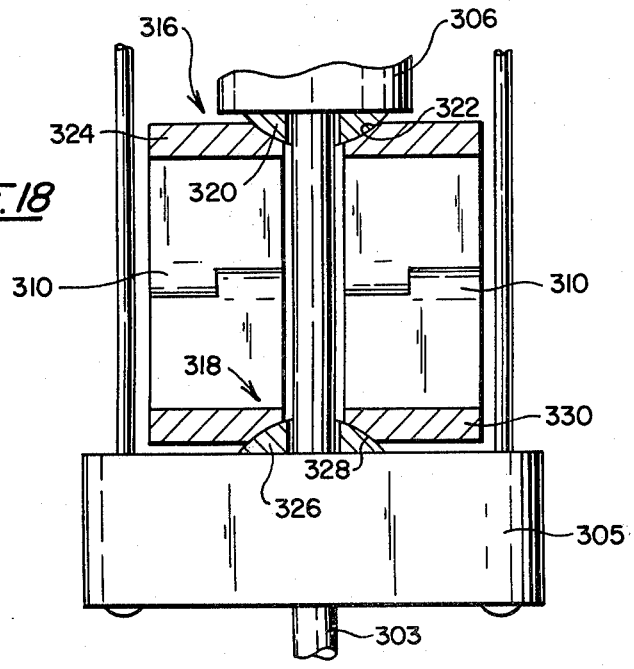
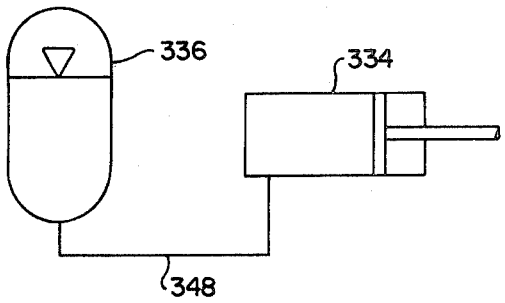
FIG. 19

METHOD FOR PUMPING A LIQUID FROM A WELL AND APPARATUS FOR USE THEREIN

This application is a continuation-in-part of my copending application Ser. No. 156,780, filed June 5, 1980 now U.S. Pat. No. 4,346,620.

BACKGROUND OF THE INVENTION

A conventional type of pump jack for pumping oil, water or other liquids from a well comprises a large rocker arm pivotally mounted on a framework. On one limb of this rocker arm is mounted a sucker rod which descends into the well and is connected to the piston of a reciprocatory pump mounted within the well, at the bottom or at some other level from which the liquid is to be pumped. Usually, a counterweight is mounted upon the opposed limb of the rocker arm to counterbalance the greater part of the weight of the sucker rod and piston. To pivot the rocker arm, and thus to reciprocate the sucker rod vertically, the upper end of a crank is fixed to the rocker arm between the counterweight and the pivot. The lower end of this crank is connected to a rotating arm fixedly mounted on a rotating drive shaft positioned below the point of attachment of the crank to the rocker arm. The drive shaft is driven via a gearbox from any conventional type of motor, this motor usually being either an electric motor or an internal combustion engine. The rotation of the drive shaft causes the sucker rod to reciprocate vertically; the motion of the sucker rod is substantially simple harmonic motion, subject only to minor, second-order deviations due to the displacement of the crank from the vertical during the rotation of the drive shaft. Thus, approximately half way through its upstroke the sucker rod is traveling at its maximum velocity and from this point there is applied to the sucker rod a progressively increasing downward acceleration until the sucker rod finally halts at the end of its upstroke. This same downward acceleration is continued into the first part of the downstroke, but decreases progressively until, approximately half way through the downstroke, no acceleration is being applied, although the sucker rod is moving downwardly at tits maximum velocity. For the remaining half of the downstroke, there is applied to the sucker rod a steadily increasing upward acceleration until the sucker rod reaches the end of its downstroke, whereupon this upward acceleration is continued but at a steadily decreasing rate until the upward acceleration ceases approximately half way through the next upstroke. The maximum accelerations imposed upon the sucker rod are considerable; for example, in a typical conventional pump jack having a stroke of three feet and a five second pumping cycle (one upstroke and one downstroke) the maximum acceleration upon the sucker rod is approximately 2.4 feet per second$^2$.

The loads imposed upon the sucker rod of an oil well pump jack are considerable. During the upstroke in a typical oil well, the weight of the sucker rod and the oil being lifted therewith amounts to about 1.6 pounds per foot of well depth, and thus about 8,000 pounds in a 5,000 foot well (many oil wells are considerably deeper). When a conventional rocker arm oil well pump is in use, it is obvious to even the casual observer that very large shock loadings are being placed upon the sucker rod as the sucker rod reverses its motion at the end of each upward and downward stroke; often the frame supporting the rocker arm can be seen to flex and vibrate, especially as the sucker rod begins its upward stroke. I have concluded that these large shock loadings upon the sucker rod arise because there is a large difference between the upwardly-directed force which is needed to stop the downward stroke of the sucker rod and that necessary to cause the sucker rod to begin its upward stroke. During its downward stroke, the sucker rod and the piston connected thereto do not have to support the weight of the column of oil within the well (obviously, the well is provided with means to prevent the column of oil flowing back down the well as the sucker rod and piston descend). Thus, to stop the downward stroke of the sucker rod, the pump jack need only impose on the sucker rod an upwardly directed force about equal to the weight of the sucker rod and piston. However, during the upward stroke of the sucker rod, not only must the sucker rod and piston be lifted, but also the column of oil within the well. Thus, at the beginning of the upward stroke of the sucker rod, the pump jack must impose upon the sucker rod an upwardly-directed force at least about equal to the weight of the sucker rod, piston and the column of oil in the well. The column of oil in a 5,000 foot well weighs above 3,000 pounds and thus at the beginning of each upward stroke this weight is instantaneously imposed upon the sucker rod, resulting in a massive shock loading thereon. Similarly, at the beginning of the downward stroke, the sucker rod is instantaneously relieved of this weight, resulting in another massive shock loading thereon. In a conventional oil well pump jack, no shock-absorbing means are provided to cushion these sudden shock loadings upon the sucker rod, which has no freedom of motion since its position is at all times rigidly fixed by the position of the rotatable arm and the drive shaft. These repeated shock loadings upon the sucker rod tend eventually to cause fractures thereof, leaving a considerable length of broken sucker rod in the well. To retrieve the broken sucker rod, a crew must be employed to fish the broken rod out through the surrounding casing, a procedure which involves considerable expense and a lengthy interruption of production from the well, since pumping of oil therefrom cannot be resumed until the broken sucker rod has been removed and replaced with a new one.

Moreover, although this has not previously been realized, I have concluded that the abrupt reversals of sucker rod motion effected by a conventional oil well pump jack are a major cause of the rapid decline in production from an oil well as pumping is carried out over an extended period. It has long been known that when a conventional oil well pump jack is installed in a well, production from the well rapidly falls to a value which is typically about 30 percent of the initial production rate when the pump jack is first installed and thereafter remains substantially constant over an extended period. For example, a typical small Ohio well will produce about 15 barrels of oil per day when the pump is first installed, but within a few weeks production will fall to about four barrels per day and thereafter remain steady for several years. I now believe that one major reason for the rapid decline in production from oil wells is that, when using a conventional oil well pump jack, the sudden reversals of sucker rod motion at the end of the upward and downward strokes cause oscillations and pressure surges (coning effects) in the oil surrounding the pump located at the bottom of the well and these oscillations and pressure surges cause particles suspended in the oil to be forced into the walls of the channels through which oil enters the well thereby clogging these channel and hindering the flow of oil into the well. The pump at the bottom of the well usually comprises a piston attached to the lower end of the sucker rod and reciprocating within a cylinder. At least one check valve is provided at the upper end of the cylinder between the cylinder and a tube which surrounds the sucker rod and through which oil is forced by the piston up to the top of the well. This check valve is open during the upward stroke of the sucker rod to allow oil to flow from the cylinder into the tube but is closed during the downward stroke of the sucker rod in order to prevent unwanted flow of oil back down the tube into the cylinder. The cylinder is provided with at least one perforation through which oil can enter the cylinder, this perforation usually being provided with a check valve which will permit oil flow into the cylinder but not outwardly therefrom. Oil enters the cylinder through this perforation during at least the latter part of the downward stroke of the sucker rod and its attached piston, but cannot enter the cylinder during the upward stroke of the sucker rod.

An oil well takes its oil from a large area surrounding the well, this area usually being of the order of several acres and the oil percolates gradually through the surrounding strata along a multitude of channels towards the oil well. In order to obtain maximum production from the well, it is desirable, I believe, that the flow of oil towards the well be as smooth and continuous as possible and that no sudden pressure surges be allowed to occur within the oil surrounding the well since as explained above, such pressure surges tend to interrupt the flow of oil towards the well and to clog the channels through which oil must percolate.

Unfortunately, the sudden reversals of sucker rod motion produced by a conventional oil well pump jack produce precisely such pressure surges within the well. As already mentioned, a conventional pump jack imposes the maximum acceleration upon the sucker rod at the extremities of its motion. At the beginning of the upward stroke, the large acceleration imposed upon the sucker rod and piston causes an extremely abrupt rise in pressure within the cylinder, a sudden opening of the check valve between the cylinder and the tube, and a very sudden end to the flow of oil into the cylinder, accompanied by a very sudden closure of the check valve or valves which allow oil flow into the cylinder, if these check valves are present. Because a considerable mass of oil is still flowing toward the cylinder, the abrupt cessation of oil flow into the cylinder produces a sudden pressure surge outside the cylinder as the oil "piles up" trying to enter the cylinder and this pressure surge thereafter passes outwardly from the oil surrounding the cylinder into the channels feeding the well, with the undesirable results previously mentioned. Similarly, because of the large downward acceleration imposed upon the sucker rod at the beginning of its downward stroke, a sudden reduction of pressure takes place within the cylinder at the beginning of the downward stroke with a corresponding sudden change in pressure in the oil surrounding the cylinder.

Moreover, it is well known that conventional oil well pumps only pump on each upward stroke a volume of oil equal to a small fraction of the swept volume of the cylinder. As already mentioned, oil enters the cylinder only during some latter part of the downward stroke of the sucker rod and piston and I believe that a major reason for the failure of the cylinder to fill more completely is the comparatively short time which the piston spends near the end of its downward stroke during a conventional pumping cycle. Results of experiments described below indicate that, if the piston is made to spend a longer time traversing the last part of its downward stroke, the resultant inflow of oil into the cylinder on each pumping cycle will be increased by an amount which more than compensates for the resulting increase in pumping cycle time, thus increasing the production of oil from the well.

It will be appreciated that the disadvantages mentioned above are not confined to oil wells, but may be experienced in other wells, such as water wells, which draw liquid from strata surrounding the well and pump it to the surface in substantially the same manner as an oil well.

Accordingly, there is a need for a method and apparatus for pumping a liquid from a well which will avoid the disadvantages of the conventional rocker arm pump jack, and my invention provides such a method and apparatus.

SUMMARY OF THE INVENTION

The instant method and apparatus for pumping a liquid from a well uses a conventional pump disposed at the bottom of the well and a conventional sucker rod. As in the conventional method and apparatus, the sucker rod is lifted by lifting means incorporated within a pump jack at the top of the well. However, in the instant method and apparatus the downward stroke of the sucker rod is not controlled by the connection between a crank and a rotatable arm. Instead, the sucker rod is allowed to descend against a resistance under the gravitational force acting on the sucker rod so that at the beginning of the downward stroke the acceleration of the sucker rod is dependent upon the gravitational force acting thereon. By "the gravitational force acting on the sucker rod" I mean the resultant gravitational force acting upon the sucker rod after due allowance is made for any counterweights incorporated within the pump jack, the weight of the piston attached to the lower end of the sucker rod, bouyancy forces acting on the sucker rod by virtue of its immersion in oil in the well, gas pressure and oil pressure acting upon the sucker rod and piston, etc. Thus, the gravitational force on the sucker rod is equal to that additional upward force which would have to be applied to the sucker rod at the beginning of its downward stroke to prevent the sucker rod beginning its downward stroke. As the sucker rod descends, the aforesaid resistance is progressively increased so that during the latter part of the downward stroke of the sucker rod there is applied to the sucker rod an upwardly-directed force greater than the gravitational force acting thereon, thereby causing a reduction in the rate of descent of the sucker rod before the sucker rod reaches the end of its downward stroke.

The invention also includes reducing the speed of descent of the sucker rod during the latter part of its downward stroke to not more than about 20 percent of the maximum rate of descent of the sucker rod during its downward stroke, and maintaining the rate of descent of the sucker rod below this value for at least about 0.5 seconds, thereby creating a pause in the motion of the sucker rod and allowing liquid to flow into the cylinder at the bottom of the well.

As a further feature of the invention, the upwardly-directed force applied to the sucker rod is progressively increased, as the sucker rod begins its upward stroke, from a value which will prevent further downward movement of the sucker rod to a value sufficient to lift the sucker rod and the column of liquid within the well, thereby commencing the movement of the sucker rod through its upward stroke without imposing a substantial impulsive loading on the sucker rod. Similarly, the invention provides for shock-absorption at the end of the upward stroke of the sucker rod by progressively decreasing the upwardly-directed force applied to the sucker rod by the lifting means as the sucker rod ends its upward stroke from a value sufficient to lift the sucker rod and the column of oil within the well to a value which permits the sucker rod to begin its downward stroke, thereby commencing the movement of the sucker rod through its downward stroke without imposing a substantial impulsive unloading on the sucker rod. Desirably the aforementioned progressive decrease of the upwardly-directed force does not begin until the sucker rod has traversed at least about 75 percent of its upward stroke.

The invention also provides apparatus for pumping a liquid from a well comprising a sucker rod and a pump jack having means for attachment to the upper end of the sucker rod, lifting means for lifting the sucker rod through its upward stroke and downstroke control means for allowing the sucker rod to descend against a resistance under the gravitational force acting on the sucker rod so that at the beginning of its downward stroke the acceleration of the sucker rod is dependent upon the gravitational force acting thereon, and for applying to the sucker rod during the latter part of its downward stroke an upwardly-directed force greater than the gravitational force acting on the sucker rod, thereby causing a reduction in the rate of descent of the sucker rod before the sucker rod reaches the end of its downward stroke.

Furthermore, the invention provides apparatus for pumping a liquid from a well comprising a pump jack having sucker rod attachment means for attachment to the upper end of a sucker rod, lifting means for lifting the sucker rod attachment means through an upward stroke but allowing the sucker rod attachment means to fall through a downward stroke and velocity-limiting means for limiting the speed of descent of the sucker rod attachment means to not more than about 20 percent of the maximum rate of descent of the sucker rod attachment means during its downward stroke and for maintaining this rate of descent of the sucker rod attachment means for at least about 0.5 seconds, thereby effectively creating a pause in the motion of the sucker rod attachment means. As a further feature, the invention provides apparatus for pumping a liquid from a well comprising a pump jack having sucker rod attachment means for attachment to the upper end of a sucker rod, lifting means for lifting the sucker rod attachment means through an upward stroke and shock-absorbing means for progressively increasing the upwardly-directed force applied to the sucker rod attachment means by the lifting means as the sucker rod attachment means begins its upward stroke from a value which will prevent further downward movement of the sucker rod attachment means and a sucker rod attached thereto to a value sufficient to lift the sucker rod attachment means.

The invention also provides apparatus for pumping a liquid from a well comprising a pump jack having sucker rod attachment means for attachment to the upper end of a sucker rod, lifting means for applying an upwardly-directed force to the sucker rod attachment means, thereby causing the sucker rod attachment means to undergo an upward stroke and buffering means for progressively decreasing the upwardly-directed force applied to the sucker rod attachment means by the lifting means as the sucker rod attachment means ends its upward stroke from a value sufficient to lift said sucker rod attachment means and a sucker rod attached thereto to a value which permits said sucker rod attachment means to begin its downward stroke.

Finally, the invention provides apparatus for pumping a liquid from a well comprising a pump jack having a rocker arm pivoted intermediate its ends, and a sucker rod attachment means mounted on one limb of the rocker arm, a link member extending downwardly from the opposed limb of the rocker arm, a pivoted lever connected to the link member, a drive means and a cam member rotatable by the drive means and contacting the lever, thereby controlling the movement of the sucker rod attachment means.

The invention will now be described in more detail, though by way of illustration only, with reference to the accompanying drawings.

BRIEF DESCRIPTION OF THE DRAWINGS

In the accompanying drawings:

FIG. 2 is a top plan view of the pumping apparatus of FIG. 1;

FIG. 7 is a schematic view of the hydraulic control system of the apparatus shown in FIGS. 1–6;

FIG. 15 is a side elevation of a fifth pumping apparatus of the invention which is mechanically powered;

FIG. 16 is an enlarged section of FIG. 15 showing its shock-absorbing and buffering means;

FIG. 17 is a horizontal section along line 17—17 of FIG. 16;

FIG. 18 is a transverse section along line 18—18 of FIG. 17; and

FIG. 19 is a schematic view of the hydraulic system of the shock-absorbing and buffering means of FIG. 16.

DETAILED DESCRIPTION OF THE DRAWINGS

Figure 1:
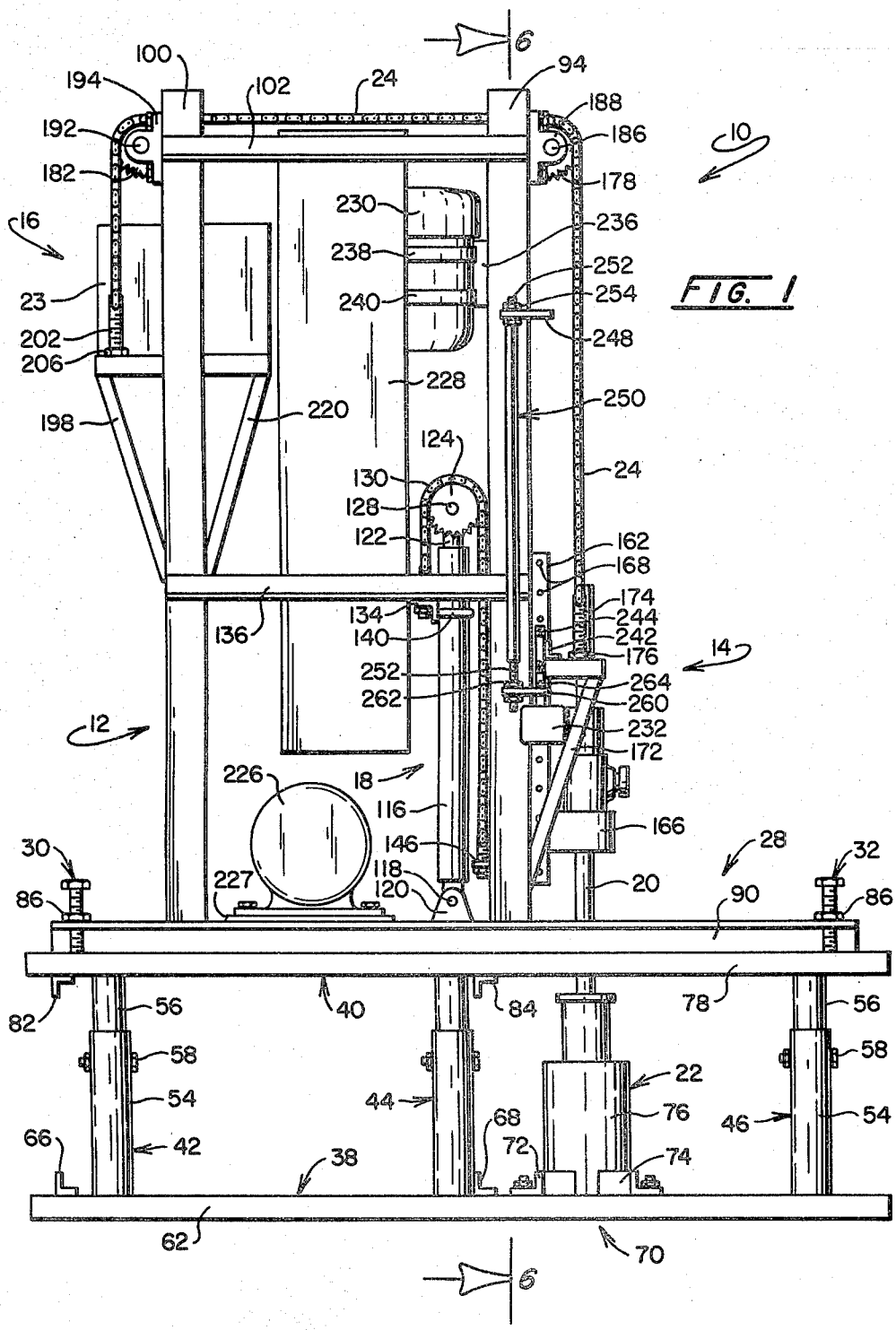
FIG. 1 is a side elevation of a first pumping apparatus of the invention which is hydraulically powered.
Figure 3:
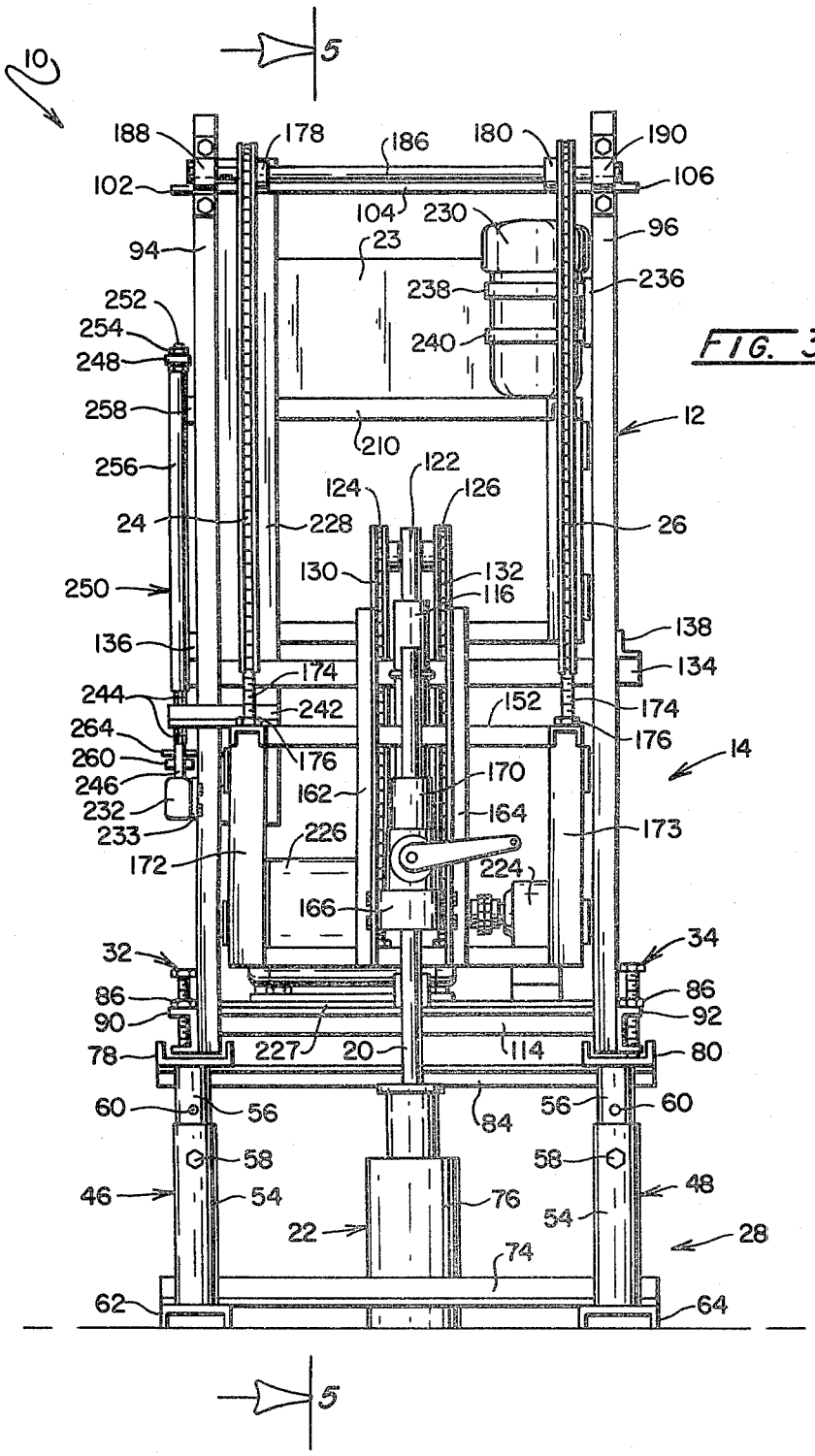
FIG. 3 is a front elevation of the pumping apparatus of FIG. 1.

The first pumping apparatus of the invention shown in FIGS. 1–7 comprises a pump jack generally designated 10 and a sucker rod 20 which reciprocates vertically within an oil well 22. Although not shown in the drawings, the lower end of the sucker rod is attached in a conventional manner to the piston of a piston-and-cylinder pump disposed within the oil well 22.

The pump jack 10 is carried on a subframe 28. The base 38 of the subframe 28 comprises two channels 62 and 64 which are interconnected by angle braces 66 and 68 for stability. If desired, the channels 62 and 64 may also be interconnected by diagonal braces if a particularly rigid base is necessary. Also connected between the channels 62 and 64 is a clamp 70 comprising a pair of brackets 72 and 74 which engage a casing 76 on the head of the well 22. This clamp 70 holds the whole subframe 28 in place relative to the well 22.

Six telescopic standards 42, 44, 46, 48, 50 and 52 extend upwardly from the channels 62 and 64. Each of these standards includes an outer tube 54 having a pair of apertures therein at opposed ends of the diameter thereof and an inner tube 56 which is provided with spaced pairs of apertures 60 (FIGS. 4 and 6) therealong. The inner tube 56 is slideably adjustable within the outer tube 54 and may be secured at any of a plurality of desired positions by passing a bolt 58 through aligned apertures in the inner and outer tubes 54 and 56 respectively and holding the bolt 58 in place with a nut. Two horizontal channels 78 and 80 comprising a table 40 of the subframe 28 are mounted at the upper ends of the standards 42, 44, 46, 48, 50 and 52 vertically above the channels 62 and 64. The channels 78 and 80 are interconnected by a pair of angle braces 82 and 84.

The pump jack 10 comprises a frame 12, the base of which comprises two channels 90 and 92 each equipped with two leveling screws 30, 32, 34 and 36. These leveling screws permit the channels 90 and 92 to be adjusted to a truly horizontal orientation even though the ground on which the channels 62 and 64 of the subframe 28 rest is not horizontal. It will be appreciated that by adjusting both the standards 42, 44, 46, 48, 50 and 52 and the leveling screws 30, 32, 34 and 36, the channels 90 and 92 may be arranged at a proper height above the ground and in a truly horizontal orientation. The leveling screws are provided with lock nuts 86 so that they may be locked in position in order to prevent the position of the frame 12 being disturbed by vibration during the operation of the pumping unit 10.

Four vertical channels 94, 96, 98 and 100 extend upwardly from the channels 90 and 92 and are interconnected at their upper ends by angle braces 102, 104, 106 and 108. The vertical channels 94, 96, 98 and 100 are also interconnected by angle braces 110, 112, and 114 adjacent their lower ends.

A first or front carriage 14 is slideably mounted for reciprocation within the channels 94 and 96, while a second or rear carriage 16 is slideably mounted for reciprocation within the channels 98 and 100. The front carriage 14 is attached to the upper end of the sucker rod 20, while the rear carriage 16 carries a counterweight 23. The proper horizontal adjustment of the channels 90 and 92 is necessary to ensure that the channels 94, 96, 98 and 100 are truly vertical so that the front carriage 14 will reciprocate vertically, thereby ensuring that the sucker rod 20 attached thereto does not bind or generate excessive friction where it enters the casing 76 at the head of the well 22.

The front carriage 14 comprises a rectangular frame 152 lying in a vertical plane and carrying roller wheels 154, 156, 158 and 160 at its corners. These roller wheels can roll along the channels 94 and 96 to effect the vertical reciprocation of the front carriage 14 along these channels. A pair of angle brackets 162 and 164 are welded to the front of the frame 152 and provided with a plurality of apertures 168. Bolts may be passed through any desired ones of the apertures 168 in order to fix to the brackets 162 and 164 a sucker rod bracket 166. The sucker rod 20 is connected to the bracket 166 by a conventional sucker rod clamp 170. Also welded to the frame 152 is an angle bracket 146 (see FIGS. 1 and 5). A pair of chain retention brackets 172 and 173 extend forwardly from the vertical sides of the frame 152.

The rear carriage 16 comprises a rectangular frame 210 lying in a vertical plane and having roller wheels 212, 214, 216 and 218 at its corners. These roller wheels roll along the channels 98 and 100, thereby permitting the vertical reciprocation of the rear carriage 16 along these channels. A pair of chain retention brackets 198 and 200 are welded to the rear of the frame 210, while a similar pair of brackets 220 and 222 are welded to the front of the frame 210. The brackets 198, 200, 220 and 222 serve as a platform for the counterweight 23. This counterweight can be lifted from its supporting brackets and replaced with a different counterweight to allow for differing weights of sucker rod depending upon the depth of the well from which oil is being pumped.

Pillow blocks 188, 190, 194 and 196 are mounted on the channels 94, 96, 98 and 100 adjacent the upper ends thereof. A shaft 186 is supported by the pillow blocks 188 and 190 on the channels 94 and 96 respectively and carries a pair of sprockets 178 and 180. Similarly, a shaft 192 is supported by the pillow blocks 194 and 196 on the channels 98 and 100 respectively and carries a pair of sprockets 182 and 184.

The two carriages 14 and 16 are interconnected by a pair of chains 24 and 26. These chains are connected to the front carriage 14 by means of threaded rods 174 attached to the brackets 172 and 173 and locked in place by a pair of lock nuts 176. The chain 24 extends upwardly from the front carriage 14, passes over the sprockets 178 and 182 and thence extends downwardly to the rear carriage 16. Similarly, the chain 26 extends upwardly from the front carriage 14, passes over the sprockets 180 and 184 and thence extends downwardly to the rear carriage 16. The chains 24 and 26 are attached to the brackets 198 and 200 respectively of the rear carriage 16 by means of threaded rods 202 locked in place by lock nuts 206.

Figure 4:
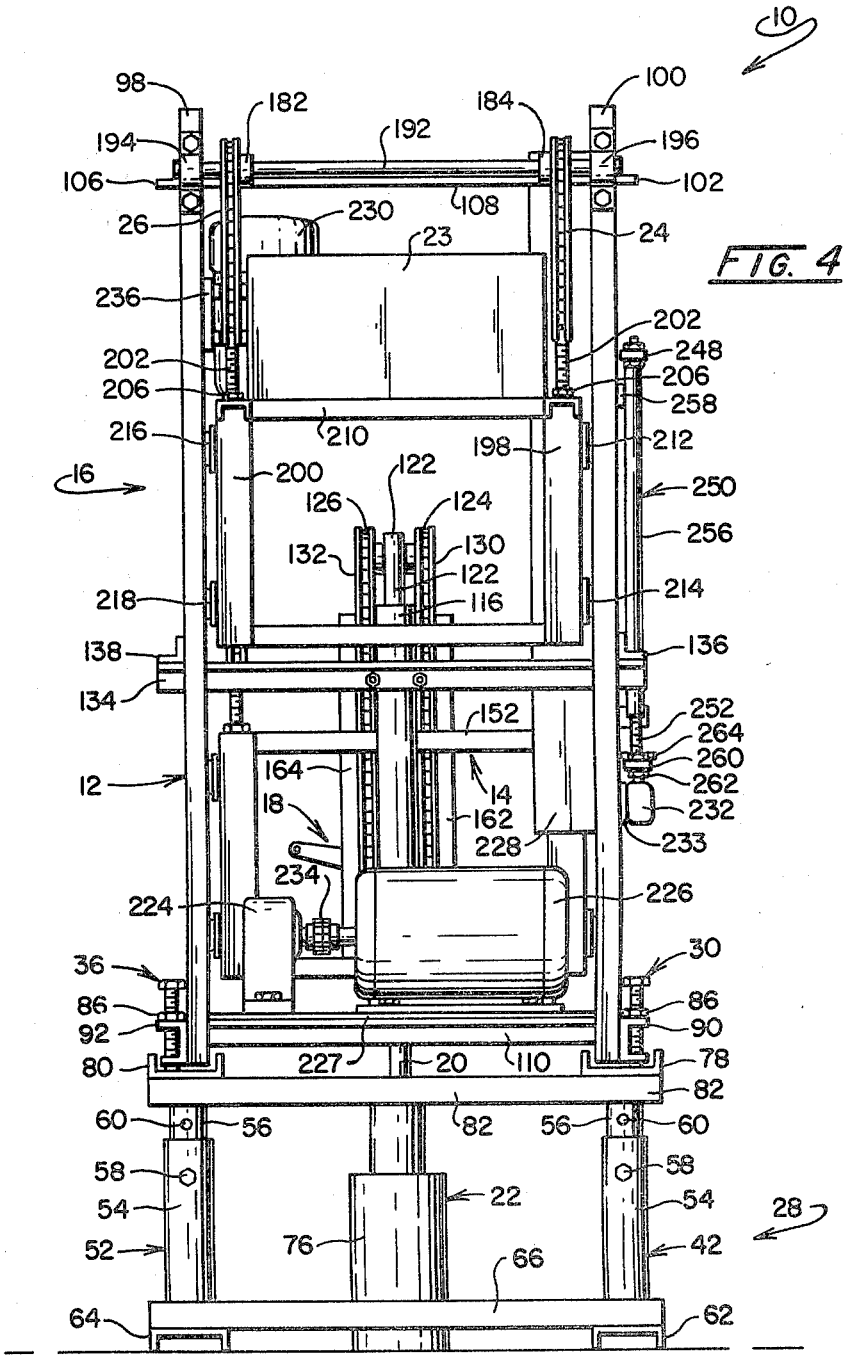
FIG. 4 is a rear elevation of the pumping apparatus of FIG. 1.
Figure 5:
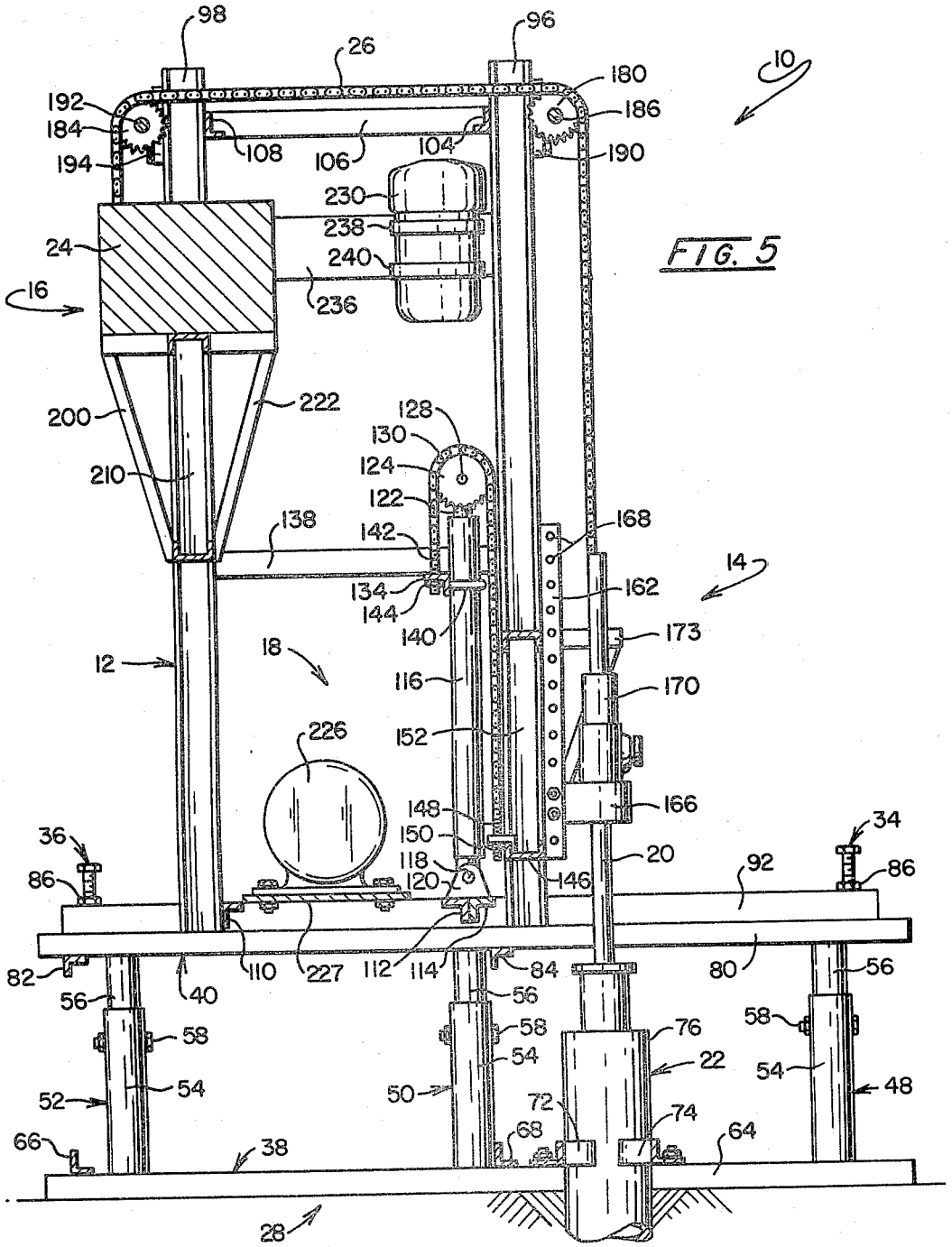
FIG. 5 is a vertical section along line 5—5 of FIG. 3.
Figure 6:
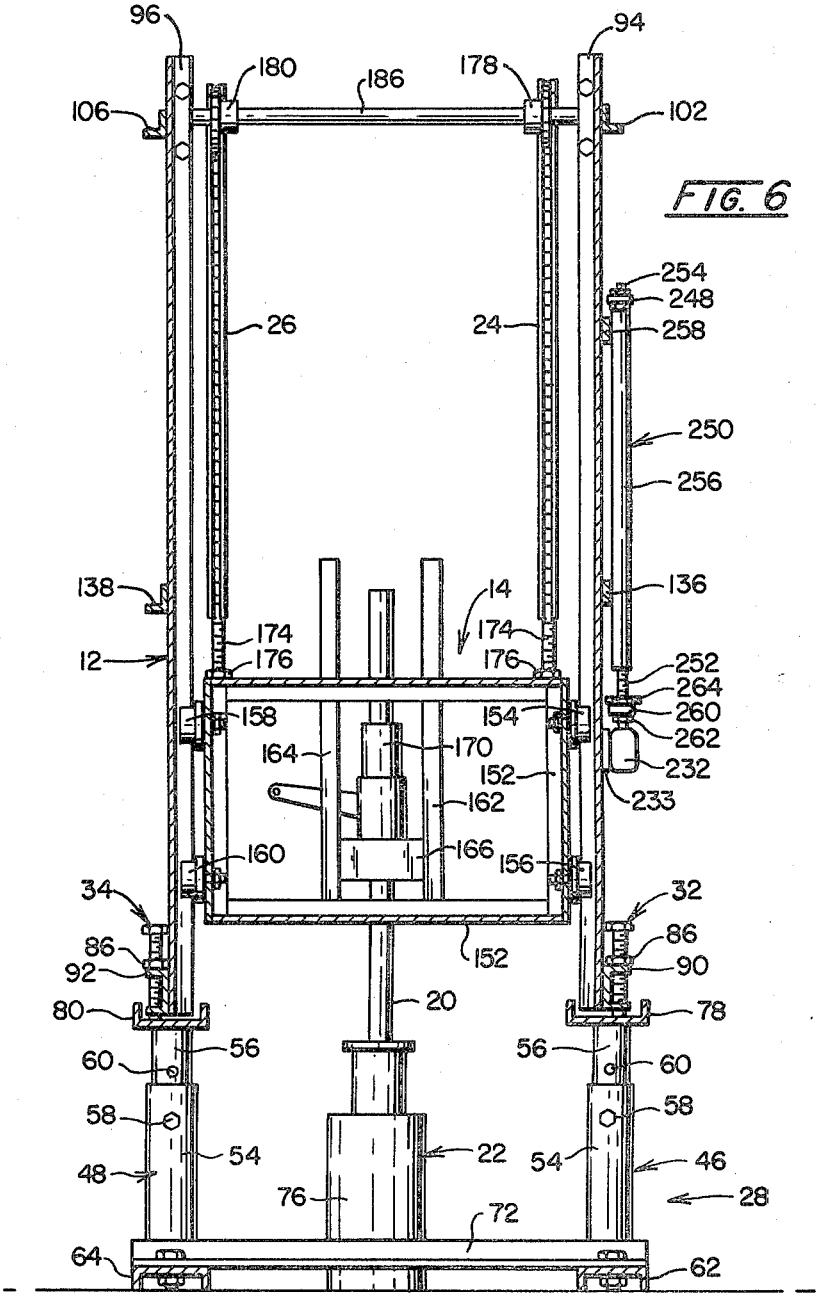
FIG. 6 is a vertical section along line 6—6 of FIG. 1.

The pumping unit 10 also includes a hydraulic control unit 18 comprising a hydraulic cylinder 116 which, as best seen in FIG. 5, is mounted by means of a pivot 118 on a bracket 120 welded to the angle braces 112 and 114. A piston rod 122 projects upwardly from the hydraulic cylinder 116 and carries a pair of sprockets 124 and 126 mounted on an axle 128. The hydraulic cylinder 116 is secured by means of a U-bolt 140 to an angle brace 134 which, as best seen in FIG. 4 is in turn welded to side angle braces 136 and 138. Brace 136 is welded to channels 94 and 100, while brace 138 is similarly welded to channels 96 and 98. A pair of chains 130 and 132 are secured to angle brace 134 by means of threaded rods 142 provided with lock nuts 144. The chains 130 and 132 pass around the sprockets 124 and 126 and thence pass downwardly to the angle bracket 146 of the front carriage 14, to which they are connected by means of threaded rods 148 provided with lock nuts 150 (best seen in FIG. 5). The chain and sprocket system 124, 126, 130, 132 enables the movement of the front carriage 14 to be equal to twice the stroke of the hydraulic cylinder 116 so that a shorter-stroke hydraulic cylinder may be used and the vertical dimensions of the pump jack thereby reduced. Besides the hydraulic cylinder 116, the hydraulic control unit 18 comprises a hydraulic pump 224 driven by a motor 226, a reservoir 228, an accumulator 230 and a changeover valve 232. The hydraulic pump 224 is a variable displacement, pressure-compensating type pump which (as best seen in FIG. 4) is driven by the motor 226 through a flexible connector 234. The motor 226 illustrated is an electric motor but obviously other types of motors powered by gasoline, natural gas, diesel fuel or the like may be used. The pump 224 and the motor 226 are mounted on a plate 227 welded to the horizontal channels 90 and 92. The reservoir 228 is mounted on the braces 102 and 136 and has the form of an elongate tank in order to provide a large surface area in order to provide a large cooling effect upon its contents. The accumulator 230 is mounted by straps 238 and 240 on a bracket 236, which is, in turn, welded to the channels 96 and 98. The valve 232, which is a three-way, two-position, mechanically controlled hydraulic valve, is provided with a plunger 246 integral with a rod 264 which effectively makes the plunger 246 "T" shaped. The valve 232 is mounted on a bracket 233, which is, in turn, welded to the channel 94 (see FIG. 3).

The vertical channel 94 has welded thereto a spacer 258 and a guide tube 256. A rod 252, forming part of a plunger lifter unit 250, extends downwardly through the guide tube 256 and carries a bifurcated lever 260, which is locked in place on the rod 252 by lock nuts 262 best seen in FIGS. 1 and 4 and which extends around the plunger 246. Besides the rod 252, the plunger lifter unit 250 includes a lever 248 which is connected to the rod 252 by lock nuts 254. The ends of the rods 252 are threaded to allow the distance between the lever 248 and the plunger 246 to be varied, thereby effecting adjustment of the pumping stroke of the sucker rod.

The bracket 172 of the front carriage 14 carries a lever 242 provided with an adjuster 244 welded thereto. As the front carriage 14 descends, the lever 242 contacts the top of the plunger 246 of the valve 232, while as the front carriage ascends the lever 242 contacts the lever 248 of the plunger lifter unit 250.

The hydraulic system of the pumping unit is shown schematically in FIG. 7. From the reservoir 228 a suction line 268 carries hydraulic fluid to the pump 224 driven by the motor 226. The pump 224 forces fluid through a pressure line 270 to the changeover valve 232. From the changeover valve 232, the fluid flows through a line 272 to the hydraulic cylinder 116. The valve 232 is shown in its upstroke position, that is to say the position it occupies when the hydraulic cylinder 116 and the front carriage 14 are on their upward strokes. In this upstroke position, valve 232 allows fluid to flow freely from the line 270 to the line 272 and thence into the hydraulic cylinder 116. When the front carriage 14 is descending, the valve 232 is shifted to a downstroke position in which the line 272 is connected to an outlet line 274, thereby allowing fluid to flow out of the hydraulic cylinder 116. The line 274 extends to a variable auxiliary restriction valve 276 whose outlet is connected to a line 278. The line 278 is connected to a variable restriction valve 280 which is arranged to allow less fluid flow than the valve 276. The line 278 is also connected via a line 282 to the accumulator 230. From the valve 280, the hydraulic fluid passes via a line 286, a fluid cooler 266 (which may be omitted if sufficient cooling of the fluid is effected in reservoir 228) and a line 288 to the reservoir 228.

The mode of operation of the appartus shown in FIGS. 1–7 is as follows. At the beginning of the upward stroke of the sucker rod 20, for reasons explained below, the volume of fluid in the accumulator 230 and the gas pressure therein are both at a maximum. At the beginning of the upward stroke of the sucker rod, the valve 232 shifts to its upstroke position, thereby connecting the lines 270 and 272 and breaking the previous connection between the line 272 and the line 274. The pump 224 can now force hydraulic fluid from the reservoir 228 via the lines 268 and 270, the valve 232 and the line 272 into the cylinder 116. After an initial sharp acceleration of the piston within the cylinder 116, the pump 224 forces fluid into the cylinder 116 at a substantially constant rate, thereby causing the cylinder 116 to extend at a substantially constant rate. The extension of the cylinder 116 causes the front carriage 14 to be lifted by the chains 130 and 132, and the sucker rod 20 is lifted with the front carriage 14. During this lifting, the weight of the sucker rod 20 is partially balanced by the counterweight 23 and the remaining parts of the rear carriage 16, the weight of the rear carriage 16 being transmitted to the front carriage 14 through the chains 24 and 26. Also during the upward stroke of the sucker rod, fluid passes from the accumulator 230 via the lines 282 and 278, the restriction valve 280, the line 286, the fluid cooler 266 and the line 288 back to the reservoir 228. By the time the sucker rod has completed its upward stroke, the volume of fluid in the accumulator 230 and the gas pressure therein have both attained their minimum values.

When the sucker rod 20 reaches the end of its upward stroke, the lever 242 on the front carriage 14 contacts the lever 248 of the plunger lifting unit 250, thereby switching the valve 232 to its downstroke position, in which the valve 232 interconnects the lines 272 and 274 while blocking the line 270 (although not shown in the drawings, the motor 224 is of the standard self-venting type provided with a relief line extending to the reservoir 228 so that, when the line 270 is blocked by the valve 232, the output from the pump 224 can be safely vented back to the reservoir 228, thus avoiding stalling of the pump 224). The sucker rod now begins to descend under the gravitational force acting thereon against a resistance which is initially determined solely by the pressure in the accumulator 230; thus, at the beginning of the downward stroke of the sucker rod, the magnitude of the acceleration of the sucker rod is determined by the gravitational force acting thereon, that is to say any increase or decrease in the effective gravitational force acting on the sucker rod (caused by, for example, increase or decrease in the weight of the sucker rod or alternatively on the counterweights on the rear carriage 16) will cause the initial acceleration of the sucker rod at the beginning of its downward stroke to increase or decrease. This is in contrast to the situation in a conventional rocker arm pump in which the acceleration of the sucker rod at the beginning of its downward stroke is limited by the motion of the rotatable arm (provided of course that the effective gravitational force acting on the sucker rod is sufficient to permit the acceleration of the sucker rod to achieve the maximum value permitted by the rotatable arm, as is always the case in practice) and thus varying the counterweight will not cause the initial acceleration of the sucker rod to vary. However, as the sucker rod 20 continues to descend, forcing fluid from the cylinder 116 through the lines 272 and 274, the auxiliary restriction valve 276, the line 278 and the restriction valve 280, the resistance to movement of the sucker rod increases steadily. Because the valve 280 is arranged to pass less fluid than the valve 276, the excess fluid passing through the valve 276 must enter the accumulator 230, thereby increasing both the volume of fluid in the accumulator and the gas pressure therein. This causes a displacement component in the resistance applied to movement of the sucker rod 20, since the amount of fluid entering the accumulator 230 is dependent upon the distance traveled by the sucker rod. Moreover, there is also a dynamic component introduced into the resistance to movement of the sucker rod 20 by the pressure drop across the auxiliary restriction valve 276 as fluid flows therethrough; this pressure drop across the valve 276 is largely responsible for controlling the rate of descent of the sucker rod, at least during the initial part of its downward stroke.

As back pressure builds up within the line 278, the pressure therein eventually briefly exceeds the pressure in the line 274, whereupon the check valve 284 opens during the latter part of the sucker rod's descent, thereby communicating this backpressure to the line to 274, the line 272 and the cylinder 116 and exerting on the sucker rod via the chains 130 and 132 and the front carriage 14 an upwardly-directed force greater than the gravitational force acting upon the sucker rod 20, thereby causing a reduction in the rate of descent of the sucker rod before the sucker rod reaches the end of its downward stroke. To produce the least possible shock on the sucker rod, the valves 276 and 280 should be adjusted so that the rate of descent of the sucker rod is reduced to zero at or before the end of the downward stroke of the sucker rod.

As the sucker rod 20 reaches the end of its downward stroke, the front carriage 14 attached thereto similarly reaches the end of its downward movement and the lever 242 on the front carriage 14 contacts the plunger 246 of the valve 232, thereby returning the valve 232 to its upstroke position in which the lines 270 and 272 are interconnected. The apparatus is now ready to commence a further pumping cycle.

Figure 8:
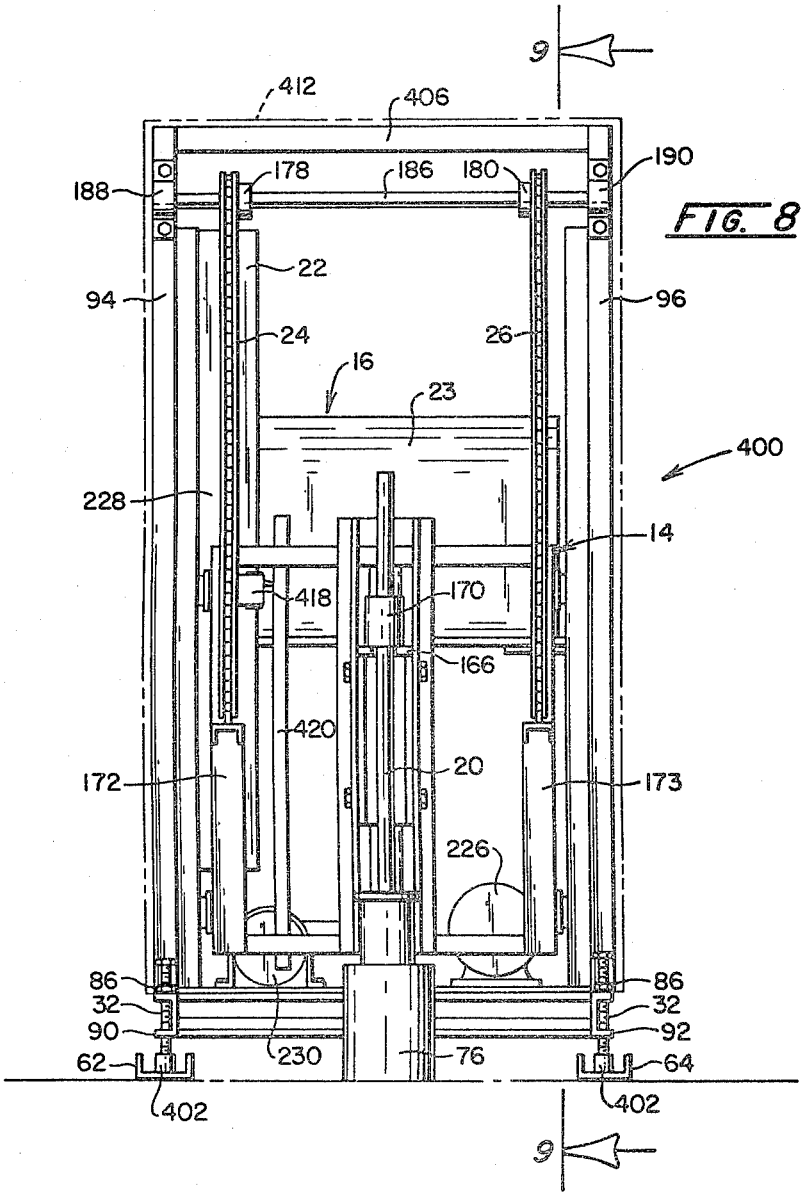
FIG. 8 is a front elevation of a second pumping apparatus of the invention, which is also hydraulically powered.
Figure 9:
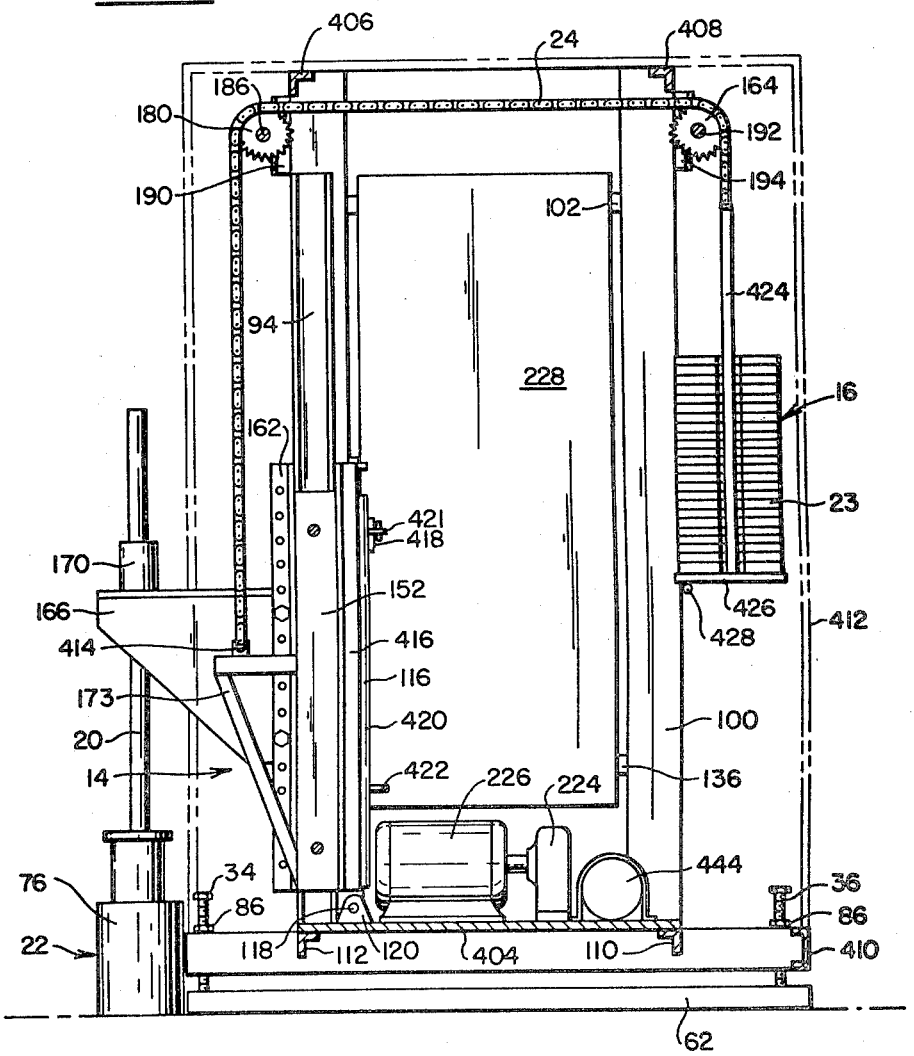
FIG. 9 is a vertical section along line 9—9 of FIG. 8.
Figure 10:
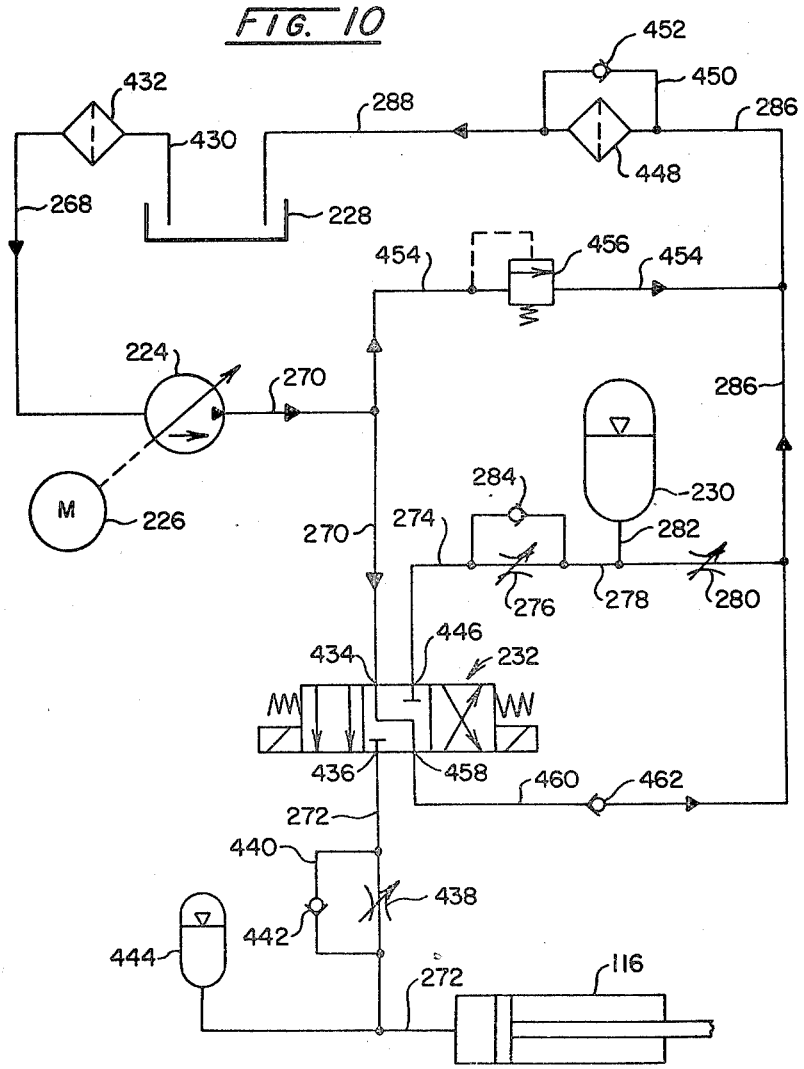
FIG. 10 is a schematic view of the hydraulic control system of the apparatus shown in FIGS. 8 and 9.

The second apparatus of the invention (generally designated 400) shown in FIGS. 8–10 is generally mechanically similar to the first apparatus shown in FIGS. 1–7, but with the following differences. The telescopic standards 42, 44, 46, 48, 50 and 52 have been eliminated, together with the two horizontal channels 78 and 80 and the associated angle braces 82 and 84. Each of the channels 62 and 64 (which now comprise the entire subframe of the pump jack) are provided with two hollow cylindrical sockets 402 and the leveling screws 30, 32, 34 and 36 have been lengthened to about 12 inches and extend into the sockets 402. Moreover, the channels 62 and 64 have been shortened so that they do not project forwardly beyond the well casing 76. This allows greater freedom in arranging the pipes (not shown) through which oil and gas leave the well casing 76. The long leveling screws 30, 32, 34 and 36 now allow for both adequate vertical adjustment and leveling of the main frame 12 of the pump jack. The angle brace 114 has been eliminated and the angle brace 112 moved forwardly to lie immediately underneath the channels 94 and 96 at the front of the frame 12. The angle braces 110 and 112, together with the channels 90 and 92 support a rectangular base plate 404 on which are mounted all the hydraulic components of the pump jack apart from the reservoir 228 which, as in the first apparatus shown in FIGS. 1–7, is supported by angle braces 102 and 136 welded to the vertical channels 94 and 100. The lower angle brace 136 has been lowered and both the depth and the width of the reservoir 228 increased in order to provide a larger reservoir capacity to allow sufficient surplus hydraulic fluid to be stored to prevent failure of the pump jack if minor leakages of hydraulic fluid occur while the pump jack is being left unattended for long periods in the field.

The upper ends of the vertical channels 94 and 96 are interconnected by angle braces 406, while the upper ends of the vertical channels 98 (not shown) and 100 are similarly interconnected by an angle brace 408. The angle braces 406 and 408, the horizontal channels 90 and 92 and angle brace 410 interconnecting the rear ends of the channels 90 and 92 all support a cuboidal housing 412 which completely surrounds the pump jack, except for the casing 76, the sucker rod 20, the sucker rod bracket 166 and the sucker rod clamp 170. The housing 412 protects the pump jack from adverse weather conditions in the field and is provided with lockable doors (not shown) through which access can be gained to all parts of the pump jack. The sucker rod bracket 166 extends through a vertical slot cut in the front face of the housing 412, this slot being the only opening in the housing 412 during normal operation of the device.

As compared with the apparatus shown in FIGS. 1–7, the front carriage 14 of the apparatus shown in FIGS. 8–10 has been modified considerably and the mounting of the cylinder 116 is different. The threaded rods 174 and nuts 176 have been eliminated and the forward ends of the chains 24 and 26 are welded directly to detents 414 upstanding from the brackets 172 and 173. The sucker rod bracket 166 has been extended forwardly so that it projects about 18 inches forwardly of the brackets 172 and 173; this allows the brackets 172 and 173 to reciprocate inside the housing 412, while enabling the sucker rod bracket 166 to support the sucker rod 20 outside the housing 412. The cylinder 116 has been moved forwardly to lie just behind the vertical channels 94 and 96 between a pair of vertical angle braces 416 which are welded to the rear face of the frame 152 of the front carriage 14. The piston rod of the cylinder is fixed to a tie bar (not shown) extending between the angle braces 416 and thus lifts the front carriage 14 directly. It will be noted that with this arrangement the stroke of the hydraulic cylinder 116 is equal to the stroke of the sucker rod 20. The lower end of the cylinder 116 is mounted by means of a pivot 118 and a bracket 120 on the base plate 404.

The change-over valve 232 is also mounted upon the base plate 404 and is shifted by means of an electrical switch 418 mounted on the vertical channel 94 adjacent the front carriage 14. A channel member 420 extends vertically between the upper and lower members of the frame 152 of the front carriage 14 and carries two detents 421 and 422 which are arranged to engage the switch 418. The detents 421 and 422 are slideable along the channel 420, but can be locked in place relative thereto by means of locknuts (not shown). As the sucker rod 20 and the front carriage 14 reach the end of their downward strokes, the upper detent 421 engages the switch 418, thereby shifting the change-over valve 232 from a downstroke to an upstroke position, whereas at the end of the upward stroke of the sucker rod 20 and the front carriage 14 the detent 422 engages the switch 418, thereby shifting the change-over valve 232 from its upstroke to its downstroke position. The adjustable vertical spacing between the detents 421 and 422 allows the length of the sucker rod stroke to be varied.

The rear ends of the chains 24 and 26 are welded to the upper ends of vertical rods 424. The lower ends of the rods 424 are welded to a flat plate 426 on which are placed counterweights 23. In this apparatus, the counterweights comprise a plurality of small blocks stacked vertically one above another to allow for easy adjustment of the counterweight by removal or addition of one or more of these small blocks. The rear carriage 16 simply hangs vertically from the chains 24 and 26 since experience has indicated that the considerable weight of the rear carriage is sufficient to prevent excessive transverse movement thereof without the need for rollers running in the adjacent vertical channels 98 and 100. However, a rod 428 is welded to the underside of the plate 426 adjacent the forward edge thereof in order to prevent the rear carriage swinging forwardly and possibly damaging some part of the apparatus; the rod 428 extends outwardly beyond the side edges of the plate 426 and is of sufficient length that it will contact the vertical channels 98 and 100 if the rear carriage 16 swings too far forwardly.

The hydraulic system of the apparatus shown in FIGS. 8 and 9 is illustrated schematically in FIG. 10. From the reservoir 228 hydraulic fluid passes via a first suction line 430 to a filter 432 and thence via a second suction line 268 to the pump 224 driven by the motor 226. From the outlet of the motor 224 a pressure line 270 extends to one port 434 of the change-over valve 232. From a second port 436 of the change-over valve 232 a cylinder supply line 272 extends to the hydraulic cylinder 116. A variable flow-restrictor valve 438 is disposed in the line 272 and a by-pass line 440 bridges this valve 438. In the by-pass line 440 is disposed a check valve 442 which will permit free flow of fluid from the cylinder 116 toward the valve 232 but not in the opposed direction. Also connected to the line 272 is a subsidiary gas-pressurized fluid tight accumulator 444.

From a third port 446 of the change-over valve 232 an outlet line 274 extends to an auxiliary restriction valve 276 provided with a by-pass line in which is disposed a check valve 284 which permits fluid flow toward the change-over valve 232 but not in the opposed direction. From the outlet of the valve 276 a further outlet line 278 extends to the inlet of a restriction valve 280. A line 282 connects the line 278 to a main, gas-pressurized, fluid tight accumulation tank 230. From the outlet of valve 280, an outlet line 286 conveys hydraulic fluid to a filter 448. The filter 448 is bridged by a by-pass line 450 equipped with a biased-closed check valve 452 which will permit hydraulic fluid to by-pass the filter 448 if the filter becomes so clogged that too great a pressure drop develops thereacross. From the outlet of filter 448, hydraulic fluid is returned to the reservoir 228 via an outlet line 228.

From the pressure line 270 a relief line 454 extends to the outlet line 286. In the relief line 454 is disposed a pilot-operated, biased-closed relief valve 456 which is arranged to open if the pressure developed in the pressure line 270 by the pump 224 exceeds a pre-determined value greater than the design pressure developed by the pump 224 in the line 270 during the upward stroke of the sucker rod.

Finally, from a fourth port 458 of the change-over valve 232 a return line 460 extends to the outlet line 286, by-passing the restriction valves 276 and 280. A biased-closed check valve 462 is disposed in the return line 460 and permits fluid to flow from the change-over valve 232 to the reservoir 228 but not in the opposed direction. The biased-closed check valve 462 has a bias sufficient to provide in the return line 460 upstream of the check valve 462 a fluid pressure sufficient to enable shifting of the change-over valve 232, which is pilot-operated. If a solenoid-actuated change-over valve 232 is employed, the check valve 462 is unnecessary and may be eliminated.

The change-over valve 232 is a four-port, three-position, pilot-operated spool valve. The valve has an upstroke position (shifted to the right in FIG. 10), in which the port 434 is connected to the port 436, thereby interconnecting the lines 270 and 272, and the port 446 is connected to the port 458, thereby interconnecting the lines 274 and 460. The valve 232 also has a downstroke position (with the valve shifted to the left in FIG. 10), in which the port 436 is connected to the port 446, thereby interconnecting the lines 272 and 274. Finally, the valve 232 has a fail-safe position in which the port 434 is connected to the port 458, thereby interconnecting the lines 270 and 460, but the ports 436 and 446 are blocked, so that the lines 272 and 274 are isolated from one another. The valve 232 is provided with biasing means (shown schematically) which cause the valve to assume its fail-safe position if the power supply to the solenoids actuating the valve is cut off. Thus, in the event of a failure of the power supply to the solenoids, the pump 224 can vent harmlessly through the lines 270, the valve 232 and the lines 460, 286 and 288 back to the reservoir 228. If desired, a flow detector may be installed in the line 270 adjacent the outlet of the pump 224, the flow detector being arranged to shut off the motor 226 if there is no fluid out-flow from the pump 224 because of excessive loss of hydraulic fluid from the system.

Figure 11:
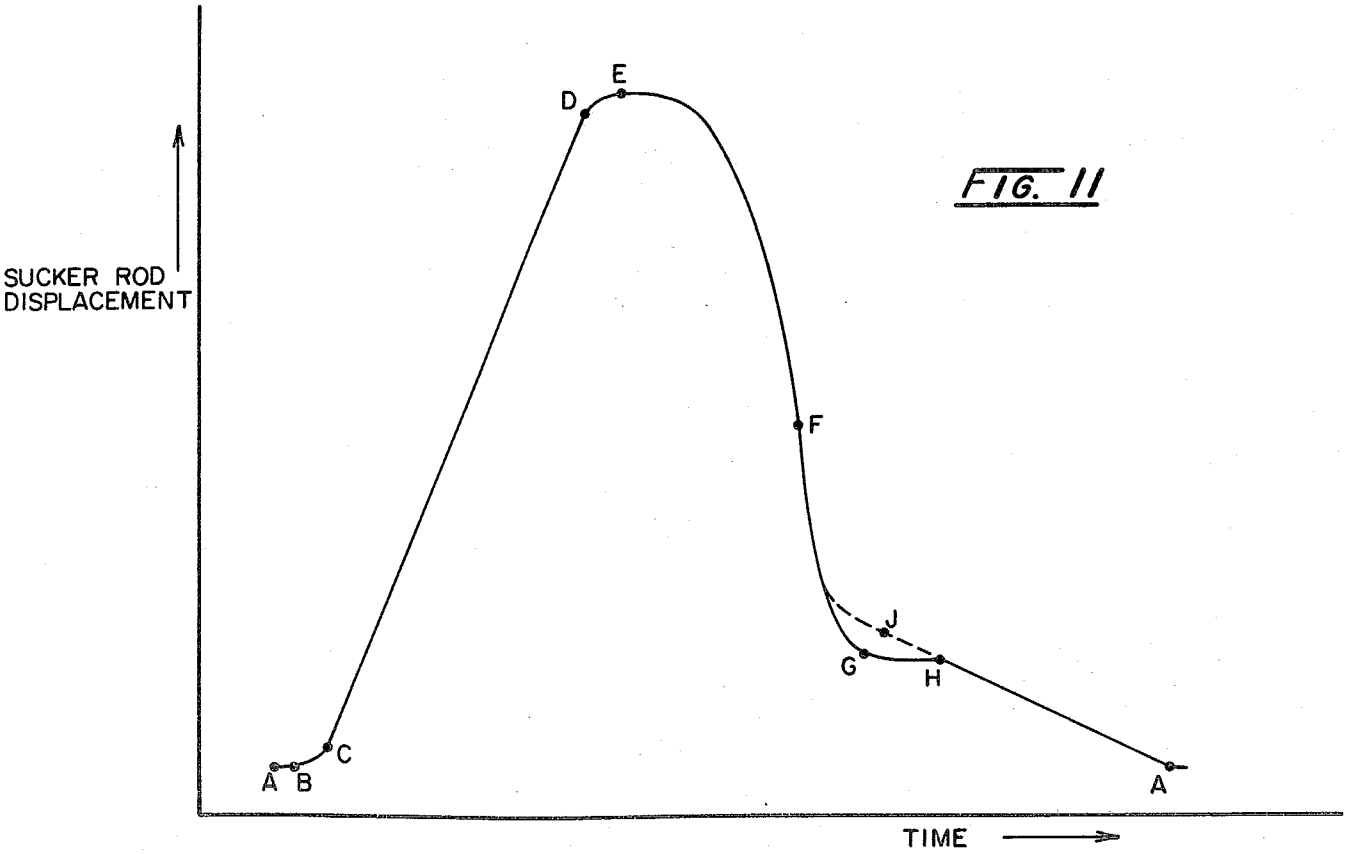
FIG. 11 is a graph showing the displacement of the sucker rod of the apparatus shown in FIGS. 8–10 against time.

The operation of the hydraulic system shown in FIG. 10 will now be described with reference to FIG. 11, which shows the displacement of the sucker rod 20 against time for one complete pumping cycle of the apparatus shown in FIGS. 8–10. At the end of the downward stroke of the sucker rod 20, for reasons which will be explained below, the amount of hydraulic fluid and the gas pressure in the accumulator 230 are at a high level, while the amount of hydraulic fluid and the gas pressure in the subsidiary accumulator 444 are at a minimum. The valve 232 now shifts from its downstroke to its upstroke position, thereby connecting the lines 270 and 272, and the lines 274 and 460. The pump 224 now forces hydraulic fluid from the reservoir 228 via the suction line 430, the filter 432, the suction line 268, the pressure line 270, the valve 232 and the cylinder supply line 272 to both the subsidiary accumulator 444 and the cylinder 116. The amount of gas in the accumulator 444 is adjusted so that, at this point in the cycle, the gas pressure within the accumulator 444 is less than the pressure needed to lift the piston within the cylinder 116. Thus, immediately after the shifting of the valve 232 to its upstroke position, the hydraulic fluid flowing through the line 272 and the restriction valve 438 does not enter the cylinder 116 but only the accumulator 444. The accumulator 444 thus provides at the beginning of the upward stroke of the sucker rod a brief pause indicated by the horizontal section AB in FIG. 11: the duration of this pause, which is exaggerated in FIG. 11, is usually of the order of a few hundredths of a second.

It should be noted that the accumulator 444 may be connected to the line 272 between the change-over valve 232 and the restriction valve 438 rather than between the valve 438 and the cylinder 116, as shown in FIG. 10. Moving the accumulator 444 to the opposite side of valve 438 will reduce the duration of the pause AB in FIG. 11, since the flow of hydraulic fluid into the accumulator 444 at the beginning of the upward stroke of the sucker rod will not be restricted by the valve 438. However, this change in duration of the pause AB has no essential effect upon the functioning of the apparatus.

As hydraulic fluid enters the accumulator 444, the pressure therein increases until eventually it reaches the value necessary to raise the piston within the cylinder 116. Fluid thus commences to flow into the cylinder 116 and there is applied to the piston an acceleration which begins at zero, increases progressively to a maximum value and then decreases to zero. This acceleration phase of the movement of the piston and the sucker rod 20 connected thereto are represented by section BC of the curve in FIG. 11. After the sucker rod has reached point C, the piston traverses the major portion of its upward stroke at a constant velocity determined by the rate at which the hydraulic fluid can pass through the restriction valve 438. This lifting of the piston and sucker rod 20 at constant velocity is represented by the straight line CD in FIG. 11. During this time, the pressure in the accumulator 444 remains the same as that within the cylinder 116, and the check valve 442 is closed. It will thus be seen that the accumulator 444 progressively and continually increases the upwardly-directed force applied to the sucker rod 20 by the cylinder 116 as the sucker rod begins its upward stroke from a value which will prevent further downward movement of the sucker rod to a value sufficient to lift the sucker rod, thus commencing the upward stroke of the sucker rod without imposing a substantial impulsive loading on the sucker rod, thereby functioning as a shock-absorber and preventing the sudden shock loading which would be imposed on the piston and the sucker rod 20 if the hydraulic pressure provided by the pump 224 were suddenly imposed upon the piston at the beginning of the upward stroke of the sucker rod.

During the upward stroke of the sucker rod, the valve 232 also connects the lines 274 and 460. At the beginning of the upward stroke of the sucker rod, the line 460 is at low pressure whereas the line 274 is pressurized by the pressure in the accumulator 230 via the lines 282 and 278 and the check valve 284, which opens immediately the pressure in line 278 exceeds that in 274. The interconnection of lines 274 and 460 enables the pressurized fluid in accumulator 230 to be vented via the lines 282 and 278, the check valve 284, the lines 274 and 460, the check valve 462, the line 286, the filter 448 and the line 288 back to the reservoir 228. By the time the sucker rod reaches the end of its upward stroke, most of the fluid originally present in the accumulator 230 has thus been vented to the reservoir 228 and thus the amount of fluid and the gas pressure within the accumulator 230 are at a minimum.

At point D in FIG. 11, switch 418 shifts the change-over valve 232 from its upstroke to its downstroke position, thereby connecting the line 270 to the line 460 and the line 272 to the line 274. The interconnection between the lines 270 and 460 enables the pressurized hydraulic fluid emerging from the outlet of the pump 224 to be vented safely back to the reservoir 228 via the line 270, the valve 232, the line 460, the check valve 462, the line 286, the filter 448 and the line 288. Although the pressurized line 278 is now connected to the low-pressure line 274 (which at point D is only under the comparatively low pressure in the accumulator 230), the pressure in the line 272 is not allowed to drop abruptly, since the accumulator 444 maintains pressure in the line 272 and within the cylinder 116 until sufficient fluid can leave the accumulator 444 via the check valve 442 and the lines 440 and 272 to reduce the pressure in the accumulator 444 to a point which the piston in the cylinder 116 and the sucker rod can begin their downward stroke; it will be appreciated that the check valve 442 will open as soon as the pressure in the accumulator 444 and the cylinder 116 exceeds that present in the portion of line 272 adjacent port 436. Thus, even after the pressure from the pump 224 is cut off from the cylinder 116 at point D in FIG. 11, the piston will continue to move upwardly through a short "over shoot" distance represented by sector DE in FIG. 11 under the influence of the pressure remaining in accumulator 444 (the overshoot distance is exaggerated in FIG. 11). Thus, as the sucker rod 20 ends its upward stroke, the accumulator 444 functions as a buffering or shock-absorbing means, progressively and continuously decreasing the upwardly-directed force applied to the sucker rod 20 by the cylinder 116 from a value sufficient to lift the sucker rod and the column of liquid within the well to a value which permits the sucker rod to begin its downward stroke, thereby commencing the movement of the sucker rod through its downward stroke without imposing a substantial impulsive loading on the sucker rod.

At point E in FIG. 11, the pressure in the accumulator 444 has dropped sufficiently to allow the sucker rod 20 to begin its downward stroke. Note, however, that the pressure within the accumulator 444 is still falling slowly during the first part of the downward stroke of the sucker rod, so that the upwardly-directed force exerted on the piston by the pressure within the accumulator 444 does not terminate until after the sucker rod has begun its downward stroke. Thus, the upwardly-directed force imposed on the sucker rod 20 by the cylinder 116 continues to decrease during the first portion of the downward stroke of the sucker rod.

At the beginning of the downward stroke of the sucker rod, the check valve 284 closes since the pressure in line 274 caused by the accumulator 444 is now greater than the pressure in line 278 caused by accumulator 230. The sucker rod and the piston within the cylinder 116 now begin their downward strokes under the gravitational force acting on the sucker rod against a resistance which is initially determined by the pressure within the accumulator 444, but which later, for reasons explained below, becomes largely determined by the pressure within the accumulator 230. Thus, unlike a conventional rocker arm pump where the initial downward acceleration of the sucker rod is entirely determined by the speed of rotation of the rotatable arm on the drive shaft, in the apparatus of the invention the magnitude of the initial acceleration of the sucker at the beginning of its downward stroke is determined by the gravitational force acting upon the sucker rod.

During the downward stroke of the sucker rod, fluid is forced from the cylinder 116 through the check valve 442, the line 272, the valve 232, the line 274 and the auxiliary restriction valve 276 into the line 278. Because the restriction valve 280 is arranged to pass less fluid than the valve 276, not all of the fluid passing through the valve 276 will pass through the valve 280; instead, a portion (in practice, the major portion) of the fluid entering the line 278 will pass via the line 282 into the accumulator 230, thereby increasing the amount of hydraulic fluid and the gas pressure within the accumulator 230. The consequent increase in pressure within the accumulator 230 and the lines 282 and 278 increases the resistance to downward movement of the piston within the cylinder 116. Thus, the resistance to downward movement of the piston and the sucker rod has a displacement component dependent upon the distance moved by the piston and the consequent amount of fluid forced into the accumulator 230, this displacement component increasing as the sucker rod descends. Moreover, the resistance to downward movement of the piston and sucker rod, which is controlled by the pressure in line 272, is affected not only by the pressure within line 278 but also by the pressure drop across the auxiliary restriction valve 276, which is in turn controlled by the amount of fluid leaving the cylinder 116 and thus by the rate of descent of the sucker rod. Thus, the resistance to downward movement of the sucker rod also has a dynamic component which varies with the velocity of the sucker rod during its downward stroke.

The resistance to downward movement of the piston within the cylinder 116 sucker rod increases continuously until at point F in FIG. 11 the sucker rod has reached its maximum rate of descent, which in practice is largely controlled by the setting of the auxiliary restriction valve 276. (If desired, the auxiliary restriction valve 276 and the associated by-pass line and check valve 284 may be omitted, so that the resistance to downward movement of the sucker rod during the majority of its downward stroke is controlled solely by the pressure within the accumulator 230. However, without the valve 276 the rate of descent of the sucker rod tends to become too large and the subsequent rapid deceleration of the sucker rod by the mechanism described below tends to become so large that excessive strains are imposed upon the sucker rod, especially in pumps intended for deep wells and equipped with very heavy sucker rods and counterweights. Thus, the omission of the valve 276 is not recommended, although it may prove possible to dispense with this valve in pumps intended for shallow wells where the weight of the sucker rod and the counterweights are comparatively small.)

After the sucker rod has passed the point F in FIG. 11, the resistance to downward movement of the sucker rod, and thus the upwardly directed force imposed upon the sucker rod by the pressure of the hydraulic fluid acting on the working surface of the piston within the cylinder 116, becomes greater than the gravitational force acting on the sucker rod, so that the rate of descent of the sucker rod is reduced before the sucker rod reaches the end of its downward stroke. The pressure with the cylinder 116 rises considerably above that which is necessary to counteract the gravitational force acting on the sucker rod since the force exerted on the working face of the piston within the cylinder 116 during the deceleration of the piston and sucker rod is greater than when the piston is descending at a steady speed. This rise in pressure in the cylinder 116 during the deceleration of the sucker rod causes a further fluid flow into the accumulator 230 and a further increase in pressure therein, although of course the presence of the valve 276 causes the pressure rise within the accumulator 230 to lag behind that in the cylinder 116.

At the same time, the deceleration of the sucker rod causes an increase in tension within the sucker rod and a consequent stretching thereof.

The deceleration of the sucker rod reaches a maximum and then falls to zero as the sucker rod adopts the substantially constant low velocity at which it completes the last part of its downward stroke, as described below. As the deceleration of the sucker rod falls, the pressure within the cylinder 116 falls for two reasons. Firstly, the decrease in deceleration of the sucker rod reduces the dynamic force on the working surface of the piston which is necessary to produce this deceleration. Secondly, after the sucker rod has stretched, it rebounds, thereby imposing an upwardly-directed force on the piston and further reducing the pressure within the cylinder. Obviously, as the pressure within the cylinder drops, the pressure within the accumulator 230 will tend to drop, but the pressure drop within the accumulator 230 will lag behind that in the cylinder 116, so that the pressure within the line 278 becomes greater than that within line 274 and the check valve 284 opens to permit the pressure within line 274 to be raised immediately to that existing within line 278.

The exact pattern of sucker rod movement during this part of the downward stroke varies depending upon the exact settings of the valves 276 and 280, the relative volumes of the accumulator 230 and the cylinder 116, the gravitational force acting on the sucker rod and the weight of the counterweights 23. If the gravitational force acting on the sucker rod is large, the momentum engendered by the downward movement of the sucker rod tends to keep the sucker rod moving as the pressure rises within the accumulator 230 to a value at which this pressure, transmitted back to the cylinder 116 via the check valve 284, and imposed upon the working surface of the piston within the cylinder 116, imposes upon the sucker rod an upwardly-directed force very much greater than that needed to balance the gravitational force acting on the sucker rod so that the sucker rod is relatively suddenly decelerated. In these circumstances, the sucker rod then tends to remain substantially stationary until sufficient fluid can leave the accumulator 230 by the restriction valve 280 to reduce the pressure within the accumulator 230 to a value at which the sucker rod can resume its downward stroke. In such a case, the movement of the sucker rod will follow the solid curve FGH in FIG. 11. On the other hand, in cases where the sucker rod does not build up a great deal of momentum during its downward stroke the pressure within the accumulator 230 does not rise so much and a steady, smooth deceleration of the sucker rod is effected, as shown by the broken curve FJH in FIG. 11. Intermediate situations will of course produce sucker rod displacement curves lying between the curves FGH and FJH in FIG. 11.

At point H in FIG. 11, the pressure within the accumulator 230 counterbalances the gravitational force acting upon the sucker rod and further downward movement of the sucker rod is controlled by the rate at which fluid can pass through the restriction valve 280 back to the reservoir 288. During this time, the amount of fluid in the accumulator 230 remains substantially constant and the sucker rod descends at a slow rate less than about 20 percent, desirably less than 15 percent and preferably less than 10 percent, of the maximum rate of descent of the sucker rod during its downward stroke, this slow rate being less than five, desirably less than two and preferably less than one, inches per second. The sector HA in FIG. 11 represents an effective pause in the movement of the sucker rod during the latter part of its downward stroke. This pause, which should last at least 0.5 seconds, desirably at least two and preferably at least five seconds, allows a comparatively lengthy period during which oil can flow into the cylinder of the pump at the bottom of the well, thus enabling more oil to enter the cylinder on each pumping cycle. Experience suggests that with a suitably long pause of at least two seconds the amount of oil entering the cylinder at the base of the well (and thus the amount of oil expelled from the well by the pump on each pumping cycle) can be tripled as compared with a conventional rocker arm pump in which there is no comparable pause in the pumping cycle. The increased amount of oil pumped on each pumping cycle more than compensates for the increased duration of the pumping cycle necessary to include the pause in the movement of the sucker rod.

When the sucker rod reaches point A, the switch 418 shifts the change-over valve 232 from its downstroke to its upstroke position, whereupon the apparatus is ready to commence a further pumping cycle.

The reduction of the rate of descent of the sucker rod to the very slow value represented by the line HA in FIG. 11 is preferably effected after the sucker rod has effected at least 75 percent of its downward stroke. Although in theory it might appear desirable to arrange the operation of the apparatus so that the sucker rod comes to a complete halt at the end of its downward stroke and remains stationary for an appropriate period, in practice such a pause cannot be achieved by the hydraulic system shown in FIG. 10 under field conditions. The position at which the pause begins is affected by the gas pressure within the oil well and in most oil wells this gas pressure fluctuates markedly over a period of several days, during which time the pump must run unattended. If one attempted to set the pause right at the end of the downstroke of the sucker rod and the gas pressure were thereafter to fall, the theoretical position of the pause would fall below the lowest attainable position of the sucker rod and in practice the sucker rod would come to a sudden halt at the end of its downward stroke, so imposing a highly undesirable impulsive loading on the sucker rod. To prevent this, the pause should be arranged to begin somewhat before the end of the downward stroke of the sucker rod, usually after the sucker rod has traversed at least 90 percent of its downward stroke.

It should be noted that the counterweights 23 not only serve to reduce the effective gravitational force acting on the sucker rod 20 during its downstroke, but, by increasing the inertia of the sucker rod, serve to smooth out the various accelerations and decelerations applied to the sucker rod 20 by the hydraulic system shown in FIG. 10. Obviously, the greater the inertia associated with movement of the sucker rod 20, the smaller will be the acceleration induced in the sucker rod by a given force applied by the hydraulic system, and by increasing the inertia associated with the sucker rod and thus reducing the accelerations applied to the sucker rod by the hydraulic system, the counterweights 23 serve to smooth the operation of the apparatus and prevent excessive accelerations and consequent excessive loads imposed upon the sucker rod.

For best results, the counterweights should be equal to one third to two thirds of the effective gravitational force which would act upon the sucker rod in the absence of any counterweights; thus, the counterweights should reduce the effective gravitational force acting on the sucker rod to two thirds to one third of what it would it would otherwise be.

In order to achieve optimum results using the apparatus illustrated in FIGS. 8–10, various parameters of the device should be adjusted within the following ranges. As already mentioned, the slow rate of descent over sector HA in FIG. 11 should not exceed 10 percent of the maximum rate of descent of the sucker rod during its downward stroke, and preferably should not exceed two inches per second. The duration of the pause GHA or JHA in FIG. 11 should be at least 0.5 seconds and preferably at least 2 seconds. Because of the need to incorporate this pause into the pumping cycle and because I have found it advantageous to employ a somewhat slower upstroke than is used in conventional pumps, the pumping cycle should be somewhat longer than the five seconds which is typical in conventional rocker pumps. I prefer that the upward and downward strokes of the sucker rod be repeated from two to eight, and most desirably three to six, times per minutes. The upstroke (ABCDE in FIG. 1) should preferably take at least four seconds and the velocity of the sucker rod during the upstroke should preferably not exceed one foot per second.

To ensure a proper relationship between the pressure in the accumulator 230 and the movement of the sucker rod during its downward stroke, the total volume of the accumulator 230 is preferably from 1.5 to 3.5 times the swept volume of the cylinder 116 and the gas pressure in the accumulator 230 is preferably arranged such that this accumulator never becomes more than about half full of fluid, although the accumulator should become at least about one third full of fluid during the downward stroke of the sucker rod. To ensure that the subsidiary accumulator 444 has sufficient capacity to produce a proper shock-absorbing action at both the beginning and end of the upward stroke of the sucker rod, without producing an excessive overshoot at the end of the upward stroke, the volume of the subsidiary accumulator 444 is desirably from 10 to 30 percent of the swept volume of the cylinder 116 and the gas pressure in the subsidiary accumulator is adjusted so that the subsidiary accumulator never becomes more than half full of fluid during the upward stroke of the sucker rod. For optimum results, the volume of the accumulator 444 is preferably about 20 percent of the swept volume of the cylinder and the gas pressure in the accumulator 444 is adjusted so that this accumulator becomes at least one third full of fluid during the upward stroke but not more than half full. With this size and gas pressure of accumulator 444, it will be found that an apparatus having a sucker rod stroke of 32 inches has an over shoot (DE in FIG. 11) of one quarter to one half inch; for obvious reasons, as already mentioned the over shoot DE is exaggerated in FIG. 11. Also, with this size and pressure of accumulator 444, it will be found that, on its upward stroke, the sucker rod does not achieve its maximum speed until it has completed at least two percent of its upward stroke, but does achieve this maximum speed before it has traversed 10 percent of its upward stroke. If the outlet pressure from the pump 224 is about 750 psi., as is conventional, the gas pressure in the accumulator 444 at the beginning of the upward stroke (point A in FIG. 11) is conveniently about 400–500 psi.

As compared with the first apparatus shown in FIGS. 1–7, the second apparatus of the invention illustrated in FIGS. 8–10 has the advantage that the majority of the fluid which accumulates in the accumulator 230 during the downward stroke of the sucker rod 20 is vented via the lines 282 and 278, the check valve 284, the line 274, the valve 232, the line 460, the check valve 462, the line 286, the filter 448 and the line 288 to the reservoir during the upward stroke of the sucker rod. Thus, the fluid can be vented from the accumulator 230 during the upward stroke of the sucker rod without having to pass through the restriction valve 280. This enables the valve 280 to be set for a much slower flow rate than in the first apparatus of the invention shown in FIGS. 1–7, in which all the fluid from the accumulator 230 must vent through the valve 280 during the upward stroke of the sucker rod in order to empty the accumulator 230 prior to the next downward stroke. The more restricted setting of the valve 280 thus achievable in the second apparatus of the invention means that the rate of descent of the sucker rod during pause GHA or JHA in FIG. 11 can be made as small as desired, which is advantageous for ensuring that as much oil as possible can flow into the cylinder at the bottom of the well, thereby ensuring optimum oil production from the well.

As compared with a conventional rocker arm pump, the apparatus shown in FIGS. 8–10 is much more compact and less obtrusive, since when installed in the field all that can be seen by the casual observer is the casing 412, the sucker rod bracket 166, the sucker rod 20 and its clamp 170 and the well casing 76. Not only is this design aesthetically pleasing when installed, but it is also safer. Conventional rocker arm oil well pumps pose considerable danger both to human beings and to animals. The operation of a conventional rocker arm pump involves the reciprocation of a rocker arm which can weigh several tons. Not only are such pumps dangerous to children or other curious onlookers who may be attracted to them, but in many parts of the United States, oil well pumps must be installed in fields where stock are grazing. It is impracticable to surround each pumping unit with a stock-proof fence and stock are naturally attracted to oil well pumping units because salt water is often pumped from the well with the oil and discharged upon the surrounding land where it dries to form artificial salt licks. Stock find these salt licks very attractive and while licking the salt adjacent a conventional rocker arm pump, they may wander underneath the rocker arm and be injured or killed as the rocker arm descends. It is virtually impossible for stock to be similarly injured with the pump shown in FIGS. 8–10 since the stock cannot easily place their head beneath the bracket 166, which is the only exposed moving part once the unit is installed and the casing closed.

An apparatus substantially as shown in FIGS. 8–10 was tested experimentally on a small oil well in Ohio which had initially produced about 13 barrels per day but whose production had fallen over the course of some years to around four barrels per day. Within two weeks after the instant apparatus had begun operations, the production from the well had increased to about eight barrels per day and the gas pressure within the well had increased by about 35 psi., thus demonstrating that by using a pumping method which does not cause sudden interruptions in the flow of oil towards the well, production from the well can be very significantly increased.

Figure 12:
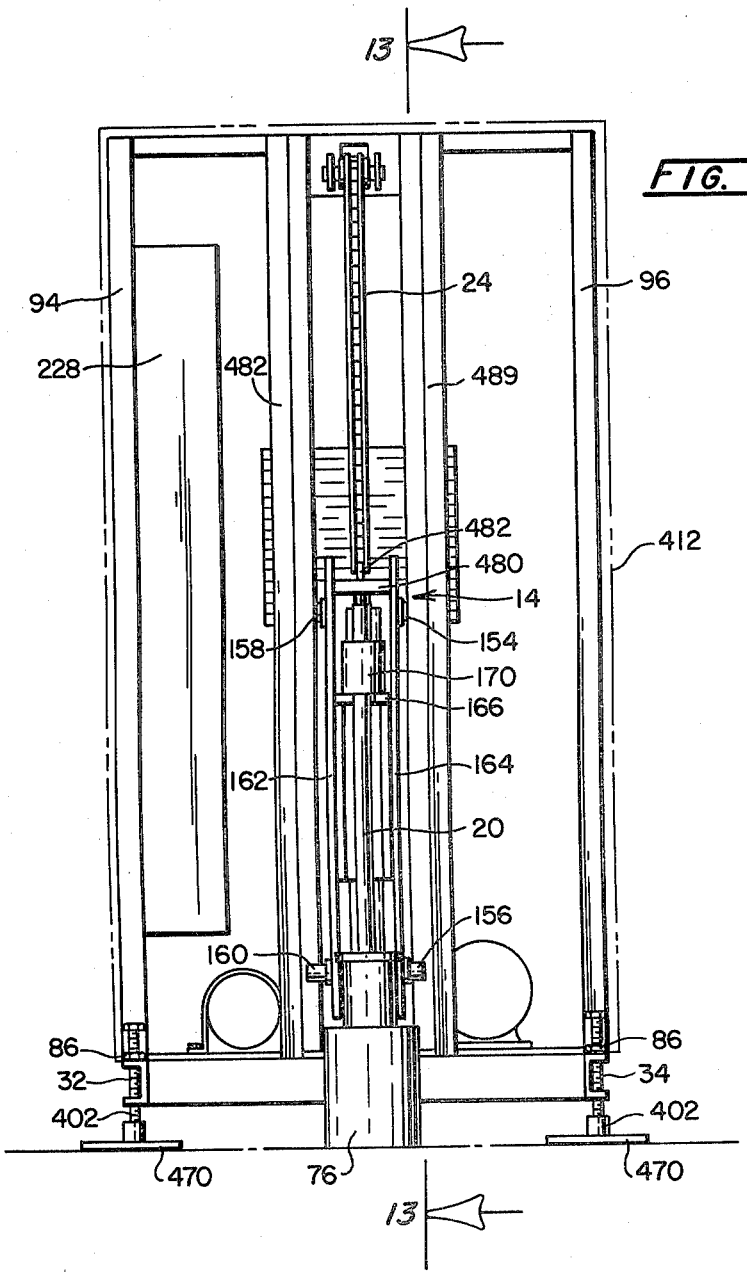
FIG. 12 is a front elevation of a third pumping apparatus of the invention, which is also hydraulically powered.
Figure 13:
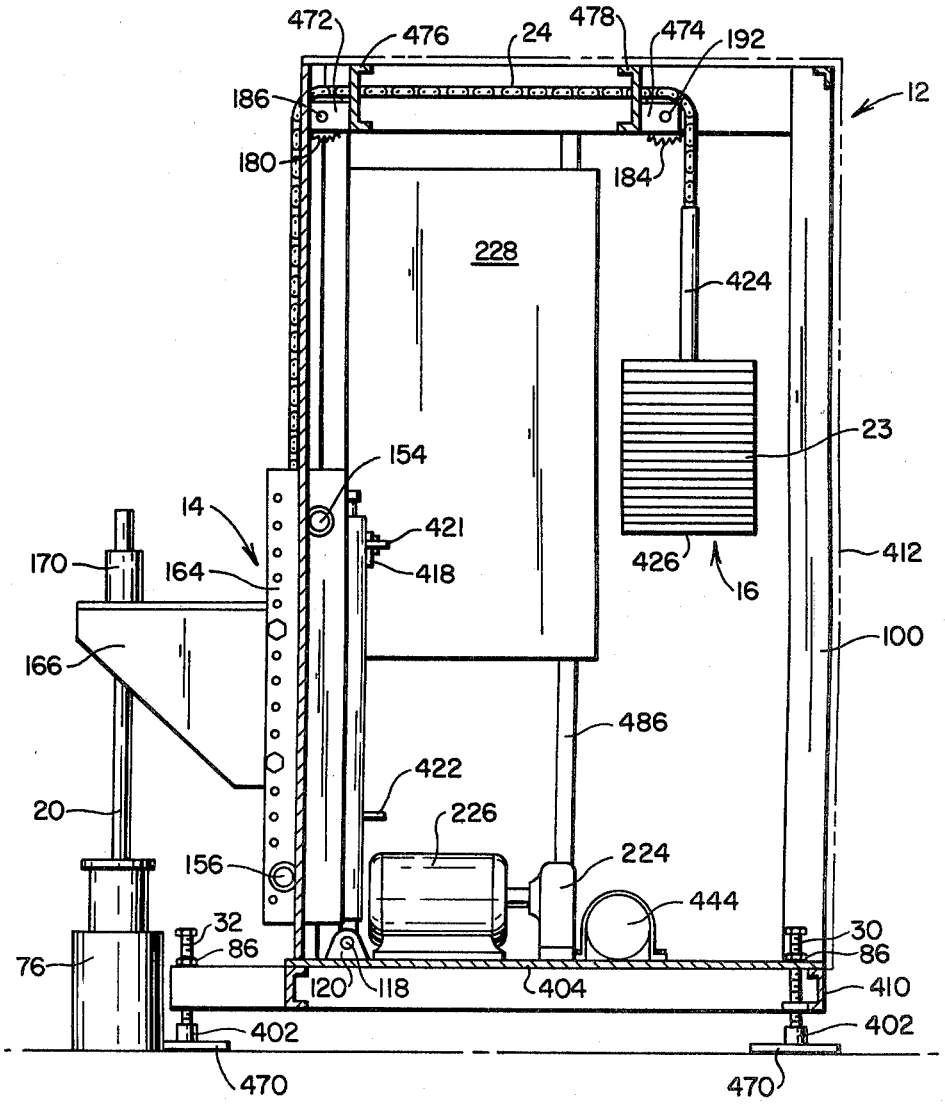
FIG. 13 is a vertical section along line 13 of FIG. 12.

The third apparatus of the invention shown in FIGS. 12 and 13, has exactly the same hydraulic system and controls the movement of its sucker rod 20 in exactly the same manner. However, there are a number of constructional and mechanical differences between the second and third apparatus. In the third apparatus, the channels 62 and 64 constituting the sub-frame are replaced by three flat base plates 470, there being one base plate on either side of the front of the apparatus but only a single base plate at the rear, disposed on the center line of the apparatus. The base plates 470 carry upwardly-extending hollow cylindrical sockets 402 precisely similar to those carried by the channel 62 and 64 in the second apparatus. Similarly, the apparatus shown in FIGS. 12 and 13 has only three leveling screws 30, 32 and 34, the single rear leveling screw 30 passing through an extended lower flange in the rear brace 410.

The apparatus shown in FIGS. 12 and 13 has only a single chain 24 lying in the central vertical plane of the apparatus and passing over sprockets 180 and 184 supported on axle 186 and 192 respectively. The axles 186 and 192 are supported on pairs of brackets 472 and 474 respectively which extend horizontally from cross-beams 476 and 478 respectively. These cross-beams extend transversely across the upper face of the frame 12 and are provided with slots to enable the chain 24 to pass therethrough. The rear end of the chain 24 is welded to a single vertical rod 424 upstanding from a flat plate 426 on which are piled the counterweights 23. As in the second apparatus shown in FIGS. 8–10, the rear carriage constituted by the rod 424, the plate 426 and the counterweights 23 is not guided by channels, but is freely suspended from the chain 24. It should also be noted that in this third apparatus of the invention the rear carriage lies forwardly of the channel members forming the rear face of the frame 12.

In the front carriage 14, the brackets 172 and 173 have been eliminated and the brackets 162 and 164 extended upwardly beyond the sucker rod bracket 160. A tie bar 480 joins the upper ends of the brackets 162 and 164 and bears an upstanding detent 482 to which the forward end of the chain 24 is welded. The vertical reciprocation of the front carriage 14 is not controlled by movement of rollers within the front channels of the frame, since the front carriage is now much narrower than the spacing between the front vertical channels of the frame 12. Instead, two vertical angle braces 482 and 484 are attached to the casing 412 on either side of the slot which enables the sucker rod bracket 166 to pass through the casing 412. Two rollers 156 and 160 attached to the lower end of the front carriage 14 roll along the front face of the angle brackets 482 and 484, while two further rollers 154 and 158 at the upper end of the front carriage 14 roll along the inside surfaces of the angle brackets 482 and 484. The downward force exerted by the sucker rod 20 on the front carriage 14 ensures that the rollers 154, 156, 158 and 160 always remain in contact with the surfaces against which they run.

The reservoir 228 has been reduced in size and is now supported by one of the vertical channels forming part of the front of the frame 12 and by a vertical strut 486 welded in a vertical position along one side of the framework 12. The third apparatus shown in FIGS. 12 and 13 is intended for use in wells not exceeding about 3,000 foot depth and the lighter loads which are imposed in sucker rods in such shallow wells require only a single chain 24 and a corresponding reduced counterweight 23, so enabling the construction of the apparatus to be simplified in the manner already described.

A further piston-cylinder combination and accumulator may be fitted to any of the three embodiments of the invention already described, this further piston-cylinder combination being connected between the rear carriage 16 and the frame 12 and being in fluid communication with the further accumulator. As the rear carriage ascends during the downward stroke of the sucker rod, the pressure in the further accumulator will rise, thus storing energy in the accumulator. When the sucker rod begins its upward stroke, the pressure in the further accumulator assists in the lifting of the sucker rod, thereby reducing the energy consumption of the apparatus.

Figure 14:
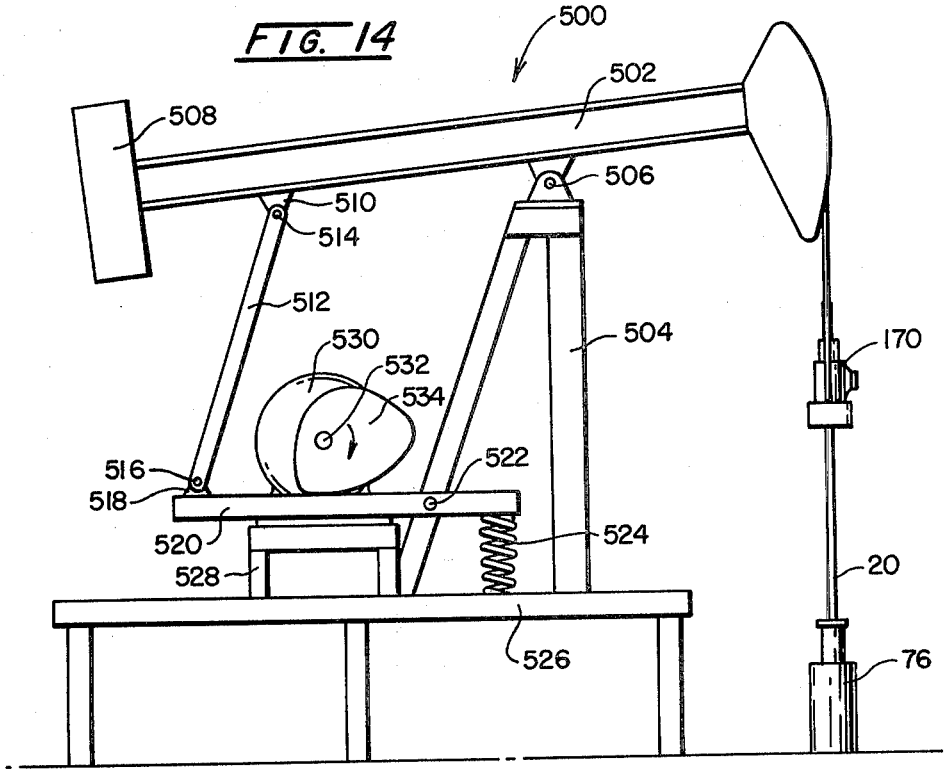
FIG. 14 is a side elevation of a fourth pumping apparatus of the invention, which is mechanically powered.

In contrast to the first three embodiments of the invention shown in FIGS. 1–13 which are all hydraulically powered, the fourth embodiment shown in FIG. 14 is mechanically powered. This fourth apparatus of the invention, generally designated 500, comprises a rocker arm 502 pivotally mounted on a frame 504 by means of a pivot 506. At the end of one limb of the rocker arm 502 is fixed a sucker rod attachment means having the form of a conventional sucker rod clamp 170 similar to those shown in the previous embodiment. At the end of the opposed limb of the rocker arm 502 is mounted a counterweight 508. As with the counterweights 23 already described, the counterweight 508 can be detached from the rocker arm 502 and replaced with differing counterweights to allow for variations in the weight of the sucker rod depending upon the depth of the well being pumped. The aforementioned parts of the apparatus are similar to those of a conventional rocker arm oil well pump.

However, in the apparatus shown in FIG. 14, the conventional crank and rotating arm arrangement is replaced by a different drive train in order to allow the movement of the sucker rod to be controlled as desired. The limb of the rocker arm 502 bearing the counterweight 508 has welded to its underside a bracket 510, to which a link member 512 is connected by means of a pivot 514. The link member 512 extends downwardly from the rocker arm 502 and the lower end of the link member 512 is connected by means of a pivot 516 to a bracket 518. This bracket 518 is welded to the upper surface of a lever 520, which is mounted on the frame 504 by means of a pivot 522. The end of the lever 520 remote from the bracket 518 carries a compression spring 524, the lower end of which is connected to a sub-frame 526, which also supports the frame 504.

A table 528 is mounted on the sub-frame 526 and carries a motor 530 provided with a drive shaft 532 carrying a cam member 534 which contacts the upper face of the lever 520. The motor 530 rotates the cam member 534 by means of the shaft 532 in the direction shown by the arrow in FIG. 14. It will be appreciated that the shape of the cam member 534 controls the movement of the lever 520 about its pivot 522, and thus via the crank 512 controls the pivoting of the rocker arm 502 about the pivot 506 and the movement of the sucker rod 20 within the well. By appropriate shaping of the cam member 534, the sucker rod can be made to undergo precisely the same pumping cycle ABCDEF-G(or J)HA in FIG. 11 as is effected by the second apparatus of the invention shown in FIGS. 8–10. Furthermore, it is relatively easy to modify a conventional rocker arm oil well pump to form the apparatus shown in FIG. 14. The crank conventionally attached to the rotatable arm can be utilized as the link member 512 and the same motor can be retained. It is only necessary to add to the conventional oil well pump the lever 520, the spring 524 and the cam member 534.

In the apparatus shown in FIG. 14, during the downward movement of the sucker rod, the end of the lever 520 attached to the spring 524 moves downwardly, thereby compressing the spring 524 and storing energy therein; during the following upward stroke of the sucker rod 20, the spring 524 assists the lifting of the sucker rod. This storage of energy reduces the power necessary to drive the motor 530.

If desired, a plurality of positions may be provided on the frame 504 for the pivot 506 by means of which the rocker arm 502 is mounted upon the frame 504. Similarly, the bracket 510 may be enlarged and provided with a plurality of positions for the pivot 514, the bracket 518 may be enlarged and provided with a plurality of positions for the pivot 516 and the lever 522 may be provided with a plurality of positions for the pivot 522 by means of which it is mounted upon the frame 504. The resultant variation in the possible positions of the pivots 506, 514, 516 and 522 may be used to change the relative lengths of the two limbs of the rocker arm 502 and the length of stroke of the sucker rod.

The fifth apparatus of the invention (generally designated 300) shown in FIGS. 15–19 is mechanically powered and uses a rocker arm 350 pivotally mounted upon a frame, a crank 290, a rotatable arm 292, a motor 296 and a counterweight 298, all of which are similar to those used in the conventional rocker arm oil well pumps. From the end of the rocker arm 350 remote from the counterweight 298 hangs a conventional sucker rod clamp 308. A shock-absorbing and buffering unit 302 is suspended below the clamp 308 between a cable retention bracket 305 and a sucker rod rotator 306, the latter being held in position by the clamp 308. From the shock-absorbing and buffering unit 302, a conventional sucker rod 303 extends down into an oil well provided with a conventional well head casing 304.

The shock-absorbing unit 302 comprises a pair of jaws 309 including an upper jaw 324 and a lower jaw 330. These jaws are pivotally connected together by means of a pivot 310 and are provided with slots 314 (see FIG. 17) to allow the sucker rod 303 to pass therethrough. The jaws 324, 330 are held in place by ball and socket units 316 and 318 which serve as bearing surfaces when the jaws are closed and which are best seen in FIG. 11. The unit 316 includes a ball 320 and a socket 322 integral with the upper jaw 324, while the unit 318 includes a ball 326 and a socket 328 integral with the lower jaw 330. As best seen in FIG. 17, the balls 320 and 326 are provided with slots 332 to allow the sucker rod 303 to pass therethrough. The balls 320 and 326 are freely slideable along the sucker rod 303 and the seating of these balls within their sockets 322 and 328 locks the shock-absorbing unit 302 in place relative to the sucker rod.

The upper jaw 324 bears a bracket 344 on which the piston rod 342 of a hydraulic cylinder 334 is mounted by means of a pivot 346. The lower jaw 330 bears a bracket 338 on which the cylinder 334 is mounted by means of a pivot 340. The cylinder 334 forms part of an accumulative cylinder unit 312 which also comprises an accumulator 336 secured to the cylinder 334 by means of a strap.

As shown in FIG. 19, the accumulator 336 and the cylinder 334 are interconnected by means of a line 348.

The shock-absorbing buffering unit 302 operates as follows. As the sucker rod 303 reaches the end of its downward stroke and the adjacent end of the rocker arm 350 begins its upward stroke the jaws 324, 330 of the unit 302 are forced toward one another, thereby forcing fluid from the cylinder 334 via the line 348 into the accumulator 336 and developing pressure within the accumulator. At first, the pressure within the accumulator 336 is insufficient to keep the jaws 324, 330 apart and thus the jaws move toward one another, thereby enabling the sucker rod 303 to continue its downward stroke, even though the adjacent end of the rocker arm 350 has already commenced its upward stroke. However, as fluid is progressively forced into the accumulator 336 and the pressure therein rises, the pressure within the accumulator 336 eventually becomes greater than that within the cylinder 334 and forces fluid back into the cylinder, so re-opening the jaws 324, 330, whereafter the sucker rod 303 is pulled through its upward stroke by the adjacent end of the rocker arm 350, exactly as in a conventional rocker arm pump. However, the continuous and progressive increase in the upwardly-directed force exerted on the sucker rod 303 by the unit 302, from a value insufficient to prevent further downward movement of the sucker rod to a value sufficient to cause the sucker rod to undergo its upward stroke, prevents the imposition of the shock upon the sucker rod which is imposed in a conventional rocker arm pump at the beginning of the upward stroke. The prevention of this shock loading upon the sucker rod 303 at the beginning of the upward stroke of each pumping cycle greatly reduces the risk of fracture of the sucker rod, and thus the risk of interruption of oil from the well and the difficult and costly recovery of the broken sucker rod from the oil well.

All the embodiments of the invention described above save energy as compared with a conventional rocker arm oil well pump since they avoid the energy losses associated with the sudden shocks generated by operation of the conventional pump. I estimate that, with proper adjustment of the counterweight 23, the apparatus shown in FIGS. 8–10 can be operated at only about one-third the power consumption of a conventional rocker arm oil well pump of the same capacity.

It will be obvious to those skilled in the art that numerous changes and modifications may be made in the embodiments of the invention described above without departing from the scope of the invention. Accordingly, the foregoing description is to be interpreted in an illustrative and not in a limitative sense, the invention being defined solely by the scope of the appended claims.

I claim:

1. Well pumping apparatus comprising:

a sucker rod pumping string;

a frame;

a first carriage slideably mounted to reciprocate in a vertical plane on the front of said frame;

a second carriage slideably mounted on the back of said frame to reciprocate in cooperation with said first carriage;

rotatable means attached to said frame;

flexible means strung over said rotatable means and connecting said first and second carriages;

a counterweight mounted on the second carriage;

a piston-cylinder combination mounted on the frame for raising said first carriage;

a reservoir for hydraulic fluid;

a fluid pump mounted on the frame in fluid communication with the cylinder for pumping hydraulic fluid from said reservoir to said cylinder to raise the piston and carriage during the ascending phase of a pumping cycle;

a fluid discharge line serving to discharge the fluid from the cylinder during the descending phase of said pumping cycle and connected in fluid communication with said cylinder and said reservoir;

first and second restriction valves connected in series in said discharge line with said first valve allowing greater flow than said second valve;

a fluid tight accumulation tank connected in fluid communication with said discharge line intermediate said two valves;

a by-pass line extending around said first valve;

a check valve mounted in said by-pass line to allow a back pressure buildup in the discharge line intermediate said first and second valves to be applied to said discharge line between said cylinder and said first valve whereby the volume of hydraulic discharge from the cylinder is decreased near the bottom of said descending phase of said cycle to thereby absorb the shock of said pumping string as it nears the bottom and begins said ascending phase of said pumping cycle.

2. Apparatus according to claim 1 wherein said flexible means comprises at least one chain and said rotatable means comprises at least one sprocket.

3. Apparatus according to claim 1 wherein an elongate rod engages said plunger, said rod being mounted with a part thereof to be lifted near the top of said ascending phase of said pumping cycle which moves said plunger.

4. Apparatus according to claim 1 wherein said back pressure build up reduces said minimum value of said rate of descent of said sucker rod pumping string substantially to zero.

5. Apparatus according to claim 4 wherein said back pressure build up reduces said minimum value of said rate of descent of said sucker rod pumping string to zero.

6. Apparatus according to claim 1 wherein said back pressure build up reduces the rate of descent of said sucker rod pumping string to a minimum value after said sucker rod pumping string has traversed at least 75% of its descending phase but before said sucker rod pumping string reaches the end of its descending phase.

7. Apparatus according to claim 6 wherein said second valve limits the speed of descent of said sucker rod pumping string after said minimum value has been attained to not more than about 15% of the maximum rate of descent of said sucker rod pumping string during its descending phase.

8. Apparatus according to claim 7 wherein said second valve limits the speed of descent of said sucker rod pumping string after said minimum value has been attained to not more than about 10% of the maximum rate of descent of said sucker rod pumping string during its descending phase.

9. Apparatus according to claim 1 including controlling valve means controlling the fluid communication between said pump and said cylinder, said controlling valve means including a plunger actuated by said first carriage.

10. Apparatus according to claim 9 including an elongate rod engaging said plunger, said rod being mounted with a part thereof to be lifted near the top of said ascending phase of said pumping cycle which moves said plunger.

11. Apparatus according to claim 10 wherein said flexible means comprises at least one chain and said rotatable means comprises at least one sprocket.

12. Apparatus according to claim 9 wherein said flexible means comprises at least one chain and said rotatable means comprises at least one sprocket.

13. Apparatus according to claim 1 wherein said second valve limits the rate of descent of said sucker rod pumping string to not more than about five inches per second after said minimum value of said rate of descent has been attained.

14. Apparatus according to claim 13 wherein said second valve limits the rate of descent of said sucker rod pumping string to not more than about two inches per second after said minimum value of said rate of descent has been attained.

15. Apparatus according to claim 14 wherein said second valve limits the rate of descent of said sucker rod pumping string to below about two inches per second for at least about two seconds after said minimum value of said rate of descent has been attained.

16. Apparatus according to claim 14 wherein said second valve limits said rate of descent of said sucker rod pumping string to below about two inches per second after said sucker rod pumping string has completed about 75% of its descending phase.

17. Apparatus according to claim 14 wherein said second valve limits the rate of descent of said sucker rod pumping string to not more than about one inch per second after said minimum value of said rate of descent has been attained.

18. Apparatus according to claim 17 wherein said back pressure build up limits said minimum value of the rate of descent of said sucker rod pumping string substantially to zero.

19. Apparatus according to claim 1 further comprising:

a suction line for supplying fluid from said reservoir to the inlet of said pump;

a change-over valve having upstroke and downstroke positions;

a pressure line for supplying hydraulic fluid under pressure from the outlet of said pump to said change-over valve; and a cylinder supply line extending from said change-over valve to said cylinder, said change-over valve, when in its upstroke position, connecting said pressure line and said cylinder supply line and, when in its downstroke position, connecting said cylinder supply line and said discharge line.

20. Apparatus according to claim 19 further comprising a relief line connecting the outlet of said pump to said reservoir, and a biased-closed relief valve disposed in said relief line and arranged to open when the pressure at the outlet of said pump exceeds a predetermined value greater than the design outlet pressure of said pump during said upward stroke of said sucker rod attachment means.

21. Apparatus according to claim 19 wherein the total volume of said accumulation tank is from about 1.5 to about 3.5 times the swept volume of said cylinder and the gas pressure in said accumulation tank is such that said accumulation tank never becomes more than about half-full of fluid.

22. Apparatus according to claim 21 wherein said gas pressure in said accumulation tank is adjusted so that said accumulation tank becomes at least about one third full of fluid.

23. Apparatus according to claim 19 further comprising two detents vertically spaced from one another and mounted on one of said first carriage and said frame and a switch mounted on the other of said frame and said first carriage so as to be capable of engaging said detents, said switch being capable of moving said change-over valve between its upstroke and downstroke positions, such that adjacent the end of said upward stroke of said sucker rod pumping string said switch will engage one of said detents, thereby shifting said change-over valve from its upstroke to its downstroke position, and adjacent the end of said downward stroke of said sucker rod pumping string said switch will engage the other of said detents, thereby shifting said change-over valve from its downstroke to its upstroke position.

24. Apparatus according to claim 23 wherein the spacing between said two detents is variable, thereby allowing the length of the stroke of said sucker rod pumping string to be varied.

25. Apparatus according to claim 19 further comprising a return line extending from said change-over valve to said reservoir without passing through said restriction valves, said change-over valve being arranged in its downstroke position to connect said pressure line and said return line.

26. Apparatus according to claim 25 wherein said change-over valve is pilot-operated and there is disposed in said return line a biased-closed check valve which will permit fluid to flow from said change-over valve to said reservoir but not in the opposed direction, the bias on said check valve being sufficient to provide in said return line up-stream of said check valve a fluid pressure sufficient to enable shifting of said pilot-operated valve.

27. Apparatus according to claim 25 wherein said change-over valve, when in its upstroke position, connects said discharge line and said return line.

28. Apparatus according to claim 25 wherein said change-over valve is provided with a fail-safe position wherein said pressure line is connected to said return line but said cylinder supply line is not connected to said discharge line, said change-over valve further being provided with biasing means which will cause said change-over valve to assume said fail-safe position if the power supply to said valve is cut off.

29. Apparatus according to claim 19 further comprising a subsidiary fluid-tight accumulation tank connected to said cylinder supply line.

30. Apparatus according to claim 29 wherein a cylinder supply line restriction valve is disposed in said cylinder supply line, a by-pass line extends around said cylinder supply line restriction valve, and a check valve is disposed in said by-pass line, which check valve which permits fluid flow from said cylinder to said change-over valve but not in the opposed direction.

31. Apparatus according to claim 29 wherein the total volume of said subsidiary accumulation tank is from about 10 percent to about 30 percent of the swept volume of said cylinder and the gas pressure in said subsidiary accumulation tank is such that said tank never becomes more than half-full of fluid.

32. Apparatus according to claim 31 wherein the total volume of said subsidiary accumulation tank is about 20 percent of the swept volume of said cylinder and said gas pressure in said subsidiary accumulation tank is such that said subsidiary accumulation tank becomes at least about one third full of fluid.

* * * * *